US007677772B1

(12) United States Patent
Wolske

(10) Patent No.: US 7,677,772 B1
(45) Date of Patent: Mar. 16, 2010

(54) NAVIGATION LIGHT SYSTEM USING SPATIALLY SEPARATED PARTIAL ARC NAVIGATION RUNNING LIGHTS

(75) Inventor: James P. von Wolske, 2107 Lakeshore Dr., Austin, TX (US) 78746

(73) Assignee: James P. von Wolske, Austin, TX (US)

( * ) Notice: Subject to any disclaimer, the term of this patent is extended or adjusted under 35 U.S.C. 154(b) by 141 days.

(21) Appl. No.: 11/462,438

(22) Filed: Aug. 4, 2006

Related U.S. Application Data

(60) Continuation-in-part of application No. 10/663,899, filed on Sep. 16, 2003, which is a division of application No. 09/982,322, filed on Oct. 18, 2001, now Pat. No. 6,637,915.

(60) Provisional application No. 60/706,364, filed on Aug. 8, 2005.

(51) Int. Cl.
*F21V 1/00* (2006.01)

(52) U.S. Cl. ..... 362/477; 362/297; 362/310; 362/351

(58) Field of Classification Search ..... 362/477, 362/520, 521; 340/984, 985
See application file for complete search history.

(56) References Cited

U.S. PATENT DOCUMENTS

| | | | | |
|---|---|---|---|---|
| 434,280 | A | | 8/1890 | Koyle et al. |
| 1,133,536 | A | | 3/1915 | Chase |
| 2,504,866 | A | | 4/1950 | Morse |
| 2,593,171 | A | | 4/1952 | Morse |
| 2,619,582 | A | | 11/1952 | Morse |
| 2,740,038 | A | | 3/1956 | Carrie |
| 2,850,621 | A | * | 9/1958 | Bateman et al. ..... 362/477 |
| 2,907,295 | A | | 10/1959 | Delaney |
| 3,192,376 | A | | 6/1965 | Najimian, Jr. |
| 3,221,162 | A | | 11/1965 | Heenam et al. |
| 3,431,408 | A | | 3/1969 | Roosevelt |
| 4,191,991 | A | | 3/1980 | Sorlien |
| 4,245,281 | A | | 1/1981 | Ziaylek, Jr. |
| 4,360,859 | A | | 11/1982 | Ziaylek, Jr. |
| 4,367,519 | A | * | 1/1983 | Houghton et al. ..... 362/477 |
| 4,441,783 | A | * | 4/1984 | Houghton et al. ..... 385/146 |
| 4,445,163 | A | | 4/1984 | Ziaylek, Jr. |
| 4,856,452 | A | | 8/1989 | Pingel et al. |
| 5,285,359 | A | | 2/1994 | Czipri |
| 5,339,225 | A | | 8/1994 | Wiggerman |
| 5,408,221 | A | | 4/1995 | Carsella, Sr. et al. |
| 5,416,670 | A | | 5/1995 | Authier |
| 5,495,401 | A | * | 2/1996 | Evans ..... 362/477 |
| 5,636,916 | A | * | 6/1997 | Sokolowski ..... 362/477 |
| 5,688,036 | A | | 11/1997 | Marshall et al. |
| 5,882,109 | A | | 3/1999 | McKinney et al. |

(Continued)

*Primary Examiner*—Hargobind S Sawhney
(74) *Attorney, Agent, or Firm*—Gary R. Stanford

(57) ABSTRACT

A navigation light system for a watercraft including multiple lights of a common color and that are spatially separated on the watercraft to collectively operate as a navigation running light that has a specified horizontal beam sector of less than 360 degrees. Each light is separately masked to emit light outwardly from the watercraft within a partial arc horizontal beam sector which is less than the specified horizontal beam sector. The navigation light system may include first and second running lights of first and second colors, respectively, where each running light includes multiple commonly-colored lights that are separately masked within a corresponding one of mutually exclusive partial arc horizontal beam sectors within the specified horizontal beam sector.

12 Claims, 32 Drawing Sheets

U.S. PATENT DOCUMENTS

| | | | |
|---|---|---|---|
| 6,086,220 | A | 7/2000 | Lash et al. |
| 6,139,170 | A | 10/2000 | Wiggerman |
| 6,155,195 | A | 12/2000 | Nirenberg |
| 6,176,601 | B1 | 1/2001 | Nester |
| 6,231,217 | B1 | 5/2001 | Krippelz, Sr. |
| 6,371,634 | B1 | 4/2002 | Tufte |
| 6,733,161 | B2 | 5/2004 | Tufte |
| 6,742,916 | B1 | 6/2004 | Dunn |
| 6,869,202 | B2 | 3/2005 | Tufte |
| 6,883,931 | B2 | 4/2005 | Tufte |
| 7,111,961 | B2 | 9/2006 | Trenchard et al. |
| 7,264,384 | B1 | 9/2007 | Ryan et al. |
| 2001/0026453 | A1 | 10/2001 | Wiggerman et al. |
| 2001/0038536 | A1 | 11/2001 | Wiggerman et al. |

* cited by examiner

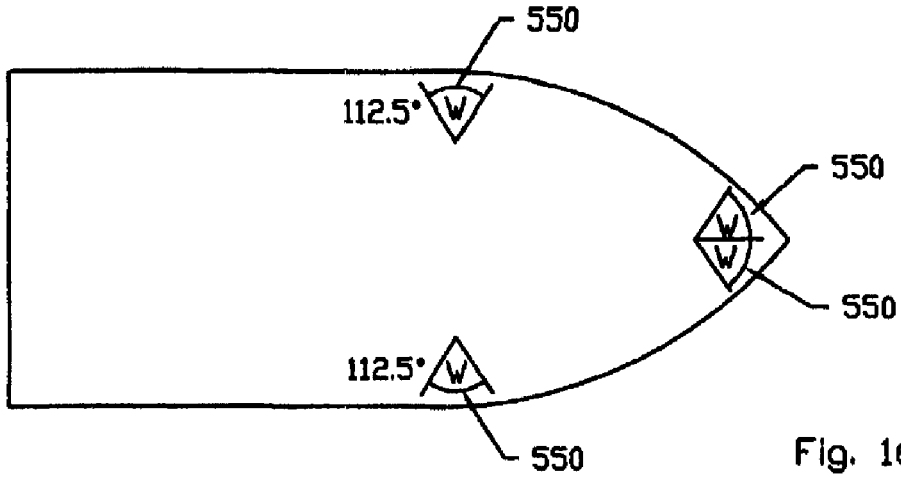
Fig. 16
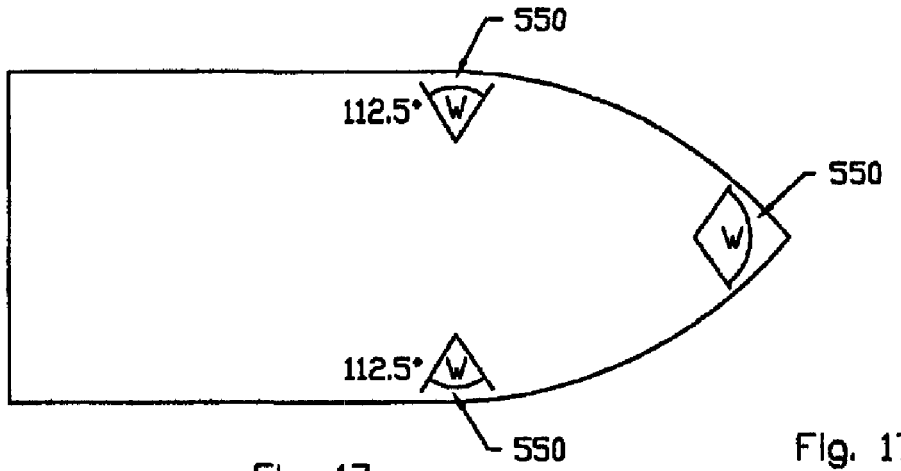
Fig. 17
Fig. 17
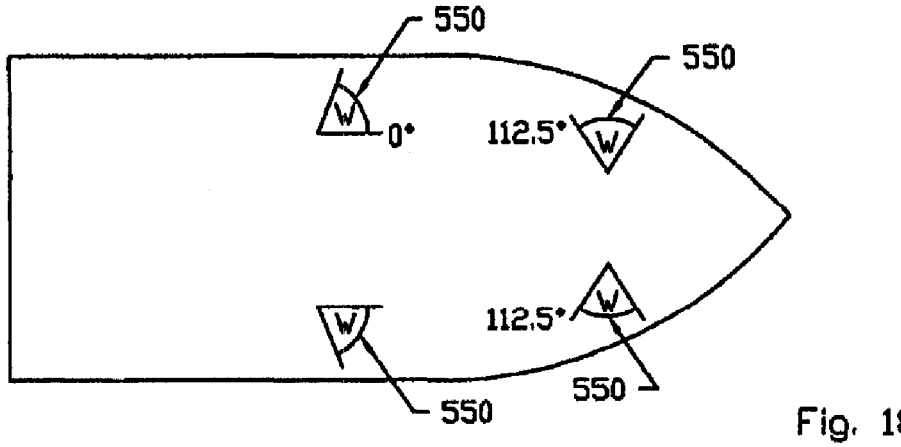
Fig. 18

NAVIGATION LIGHT SYSTEM USING SPATIALLY SEPARATED PARTIAL ARC NAVIGATION RUNNING LIGHTS

CROSS-REFERENCE TO RELATED APPLICATIONS

This application claims the benefit of U.S. Provisional Application Ser. No. 60/706,364, filed on Aug. 8, 2005, which is herein incorporated by reference for all intents and purposes.

This application is a continuation-in-part of U.S. patent application Ser. No. 10/663,899 entitled "A Docking Light System Including An Accessory Lamp" having a common inventor, which is itself a divisional application of U.S. patent application Ser. No. 09/982,322 entitled "Navigation Light System and Method" filed Oct. 18, 2001, having a common inventor and now issued as U.S. Pat. No. 6,637,915, both of which being hereby incorporated by reference in their entireties for all intents and purposes:

BACKGROUND OF THE INVENTION

1. Field of the Invention

The present invention is directed towards a navigation light system for watercraft, and more particularly towards a navigation light system that employs spatially separated partial arc lights which are collectively the optical and functional equivalent of existing navigation running lights.

2. Description of the Related Art

Navigation lights are required for operation of a boat at nighttime. The United States Coast Guard has established Navigation Rules for these lights. These Navigation Rules are also published by the American Boat and Yacht Council in Section A16 of their handbook. Section A16 illustrates these lights as emitting a beam of light shaped as a radial wedge of light shining out across the water surface. Each type of light fixture shall emit light of a certain color and intensity over a prescribed horizontal arc and over a prescribed vertical arc of an intensity to be visible by an observer located at a prescribed distance relative to the watercraft. The rules recognize the physical constraints of mounting these light fixtures and the necessity for other appurtenances and hardware on the boat and therefore allow for some hardware to be placed in the beam of light as long as the hardware does not interrupt more than 6 horizontal degrees of the light beam. This interruption of the light beam is called occlusion. Some occlusion is permitted, but it is undesirable.

Occlusion, or occluding is the undesirable process whereby the beam of light is blocked from its desired or otherwise intended outward path by striking parts of the boat or people that are standing in the way of the light beam. Occlusion of the beam is detrimental to both the operators of the boat and to distant observers of the boat. It is detrimental to the operators of the boat because the light striking the occluding object reflects back towards the operator and causes glare in his eyes that reduces his night vision capability. It is also detrimental to a distant observer of the subject boat because the allowed occlusion obliterates the very same light that the distant observer needs to see in order to inform him of the presence of the subject boat and take necessary evasive action. Occlusion and glare are often the unavoidable result of using only one light centrally located on the boat and is a common problem on most boats. Even the use of two lights as directed by the Navigation Rules causes glare and occlusions.

The Navigation Rules have recently imposed a caveat that required navigation running lights be mounted in a fashion to minimize glare and maximize brightness. These two goals are couched in regulatory lexicon of "maintain proper lookout" (which is intended to minimize glare as perceived by an operator) and "maintain conspicuity" (which is intended to increase light brightness and maintain a continuous display as perceived by a neighboring boat). The Navigation rules do not explicitly use the term "running light" but instead uses the term "underway" to define which lights are required when a watercraft or vessel is not at anchor, or made fast to the shore, or aground (definition of "underway" according to Rule 3(i) of the General Definitions). As used herein, the term "running light" is intended to mean those lights that are required to remain on while the watercraft or vessel is underway as understood within the definitions of the Navigation Rules.

The Rules for the beam spread requirement for each of the different navigation running lights has some similarities for the different running lights. As used herein, the beam spread of a navigation running light is defined in terms of "sectors" including vertical sectors and horizontal sectors. The vertical sector is the included angle of emission of the light outwardly from the boat as declared by the upper and lower limits of the angle relative to an external reference, wherein the external reference is generally the horizontal plane. For example, the Rules state that at least the required minimum intensity is maintained at all angles from 5 degrees above to 5 degrees below the horizontal and at least 60 percent of the required minimum intensity is maintained from 7.5 degrees above to 7.5 degrees below the horizontal. Basically, the Rules require the vertical sector to be +/−5 degrees from the horizon and tapering off to a minimum of +/−7.5 degrees, but do not specifically refer to a maximum angle. Practical lights should have increased vertical sectors since the watercraft may lean from side to side while underway. This is particularly true for sailboats that lean way over while underway, so that the vertical sector for sailboats should be larger than for powerboats, e.g., +/−30 degrees. The horizontal sector is the included angle of emission of the light outwardly from the boat as declared by the forward and rearward limits of the angle relative to an external reference, wherein the external reference is the front to rear centerline of the watercraft. Masking is typically defined by the term "screens" and that is usually part of the fixture or an adjacent part of the boat, e.g., the hull. For example, the vertical beam spread is 7.5 degrees above the horizon to 7.5 degrees below the horizon for all navigation running lights. However, the horizontal beam spread for the red and green side marker lights is 112.5 degrees for each of the lights. The horizontal beam spread for the masthead light is two times 112.5 degrees, or 225 degrees centered about the straight-ahead direction of the boat. The beam spread for the steaming light is 225 degrees centered about the straight-ahead direction of the boat. The beam spread for the stern light is 135 degrees centered about the straight behind direction. The beam spread for the all-around light is 360 degrees, and is configured as the consolidation of the masthead light, or the steaming light, and the stern light into one fixture. As a convenience for discussion for a navigation light system according to the present invention, the horizontal beam spread is referred to as the horizontal sector and the vertical beam spread is likewise referred to as the vertical sector.

The angle of 112.5 degrees comes from an archaic concept. The Navigation Rules require that the red and green side marker lights start at straight ahead and end at a back angle of "two compass points abaft of athwart ship." What this meant to old sailors was that the red and green lights had to extend from straight ahead to around on each side of the boat to slightly behind each shoulder. The term "athwart ship" means directly out to the sides at 90 degrees from the longitudinal centerline of the boat. The term "abaft" means toward the rear, or "aft", end of the boat. To better define the angle, it was expressed in terms to which they could relate which was the dial of a compass. There are 32 points on a compass dial. One compass point is 11.25 degrees because there are 32 directional points on the dial of a compass. This is calculated by dividing 360 degrees by 32 points, and therefore equals 11.25 degrees per point. At 90 degrees to the left of the straight ahead direction is the port side and is called the port side athwart ship. The old sailor's left shoulder was at the port side athwart ship. Therefore, "two compass points abaft of athwart ship" is 90 degrees plus another 22.5 degrees, which equals 112.5 degrees, and is the required cutoff point for the port side marker lights and the masthead lights. Similarly, the starboard side cutoff is two compass points abaft of the starboard side athwart ship direction. The starboard cutoff line is 112.5 degrees to the right of straight ahead. The precision of the arithmetic is unfortunate because it forces the designers of these lights to direct their attention to a falsely precise number and often disregard the consequences of glare and occlusion.

It was probably not intended that this cut-off angle be enforced with blind determination. But more likely this cut-off angle was selected as an angle to which old sailors could relate to the course direction of a neighboring boat. Therefore, it allowed an operator who sees the red or green lights of a neighboring boat to be aware of possible collision due to closing paths. Whereas, if the red or green lights are not visible, the observed boat is on a departing heading and collision is less imminent. At night, the human eye cannot discern angles within a half of a degree of precision. In fact, it takes a very special person to be able to discern 15 degrees. Rigorous pursuit of such minutia often leaves unsolved the larger issues of visual safety as it relates to conspicuity and proper lookout.

Also of historical interest is the permitted use of a single "360 degree" or "all around light" as a suitable substitute for the required 225 degree masthead light plus the 135 degree stern light. This substitution of one light for two lights is permitted in accordance with the Navigation Rules, on boats less than 12 meters in length. This was done as a convenience and cost saving measure for the benefit of small boats. Thus, the use of a single light is considered the functional equivalent of two spatially separated lights where each light satisfies the concept of a piecewise continuous partial presentation to an observer. And by deduction, the converse is also true as this fact is the basis for allowing the 360 degree light. That is to say, piecewise continuous partial arc lights are functionally equivalent to a single light. They are functionally equivalent because they are optically equivalent. Often better.

Although the Navigation Rules show single fixtures, there is no real valid scientific basis as to why these different lights cannot be configured differently and still be optically equivalent to the original standard as prescribed by the Navigation Rules.

It is a reality of three-dimensional spatial geometry that when viewing navigation lights, visual separation always means there is spatial separation, but spatial separation does not always mean there is visual separation. This is because two spatially separated points of light in a darkened, three-dimensional field can be rotated to appear to visually merge, that is to appear to have no visual separation. Conversely, two spatially merged points of light cannot be rotated to appear to be visually separated. This is one of the precepts of geometry in three-dimensional space.

Safe operation of a boat at night requires that an operator be able to see and that the boat be seen. This is a double requirement. The first goal is to design the lighting system so as to reduce the glare that impairs an operator's ability to see out into the darkness. The second goal is to increase the brightness of the lights on a boat such that an operator's boat can readily be seen by a distant observer. This ability to be seen is reduced by the problem of occlusion in prior art.

All types of glare are detrimental to an operator's ability to see. There are at least five types of glare. There is primary glare, secondary glare, reflected glare, re-reflected glare, and bloom. Primary glare is light that is emitted straight from the filament of a lamp. Secondary glare is light that is emitted from the lens of a light fixture wherein the light is that portion which is deflected away from the desired direction designed as part of the intent of the fixture. This secondary glare is easily observed as the light spilling off the lens of a flashlight when the light is observed from slightly ahead of the light, but off to the side of the light beam. Secondary glare is the source of much of the glare problem associated with navigation light installation and operation. Reflected glare is light that strikes an object somewhere in the view of the operator and reflects back into an operator's eyes. Re-reflected glare is light that strikes an object somewhere in the view of an operator and wherein the light is emanating from another reflective surface. Bloom is caused by light that strikes particles in the air such as mist or dust, and causes the air to glow from the light. Fog is a primary cause of bloom.

The diagrams of light beams as presented by the regulatory authorities are over simplifications of classical lens theory. These diagrams do not take into account the difference between lens theory and lens reality. Real life lenses all exhibit diffusion and less than perfect transmission and refraction. These realities give rise to these sources of fugitive light. Fugitive light is any light that goes where it is not wanted and usually causes harmful glare. This harmful glare impairs an operator's ability to see. An operator is not limited to the driver, but may include anyone who contributes to visual look out, and may include even a passenger who casually looks out into the darkness.

The second requirement of nighttime boat operation is that the boat shall be capable of being seen by a distant observer. This requirement is stated as the need to maintain conspicuity. It is obvious that the brighter the lights are on a boat, the more conspicuous it is. However, it would be counterproductive to make the navigation lights so bright that they excessively contribute to the glare problem and thus impair the operator's ability to see. There are regulatory limits on the minimum and maximum brightness of navigation lights. The minimum brightness requirement is to ensure that a distant observer can see the boat. The maximum brightness limit is imposed so that these lights do not temporarily blind an oncoming boat. These limits prohibit the use of docking lights and spotlights while normally operating on the water. However, these limits do allow the non-steady use of searchlights that are manually controllable and do not present a continuous blinding effect to an oncoming boat. There is also a practical limit on the maximum brightness because if a light is too bright, it tends to cause too much glare to the operator and it uses an excess of power.

The physiology of the eyeball is such that even very low levels of light in a person's field of vision, even in the periphery, cause a severe reduction in the ability to see in the darkness. The eye has photoreceptors called rods that are located predominately on the periphery of the retina. These rods are extraordinarily sensitive to low levels of light and tend to over emphasize the effect of peripheral sources of glare. The center of the retina, called the fovea, is saturated with photoreceptors called cones that respond primarily to colors and detail discrimination. This is why people see ghosts out of the corner of their eye, but loose sight of the ghost when they look directly at it. It disappears like a ghost. This is also why it is desirable to configure a lighting system that eliminates even small sources of glare, even those located off to the side of, or above or below, the normal direction of view.

One problem with prior art lights is glare. Excessive glare is usually caused by the placement of a navigation light somewhat centrally located in the boat such that fugitive light casts downward into the cockpit and deck areas of the boat and tends to adversely affect the boat operators ability to see at night. Excessive glare is also caused when the intended and outwardly directed light beam strikes objects or people on the subject boat. In either case, excessive glare is undesirable because it impairs the boat operator's ability to see into the darkness of night as part of his requirement to "maintain proper lookout". Glare can be reduced or eliminated by proper placement of spatially separated, piecewise continuous, partial arc white lights.

The problem with glare is so severe that it causes some boaters to shut off their lights while running at night. Even though this practice is illegal and dangerous, it is a risk taken by the operator who is desperate to eliminate glare. Running with no lights, or "running dark", is fairly common in relatively deserted areas such as coastal waters or rivers where it is important for the operator to fully see navigation hazards or navigation aids. The operator calculates the risks and judges that the benefits outweigh the consequences. The operator considers this practice of running with the light off to be less dangerous than running with his lights on, irrespective of what the law dictates. Other operators will stand up to intentionally block the rear mounted, yet forward directed light from striking the foredeck and causing glare. This intentional occlusion of the light is dangerous because a neighboring boat directly ahead cannot see the subject boat. Although it is dangerous, it is usually not illegal for an operator or a passenger to occlude his own light.

A second problem with prior art lights is occlusion. Occlusion is usually caused by the placement of a navigation light somewhat centrally located in the boat and whereby the objects or people in the boat block the outwardly directed light beam from being seen by a distant observer. Thus, the subject boat cannot be seen at all times from all angles and therefore does not meet the requirement to "maintain proper conspicuity". Occlusion can be reduced or eliminated by proper placement of spatially separated, piecewise continuous, partial arc white lights.

Prior art navigation lights use a single lamp inside a fixture. The lamp is usually an incandescent type with a tungsten filament inside a glass globe. This lamp is covered by a lens that protects the globe and gives red or green color when needed, to the white light emitted from the filament. Various lamp wattage and luminosity is available for a full range of applications.

Light Emitting Diode (LED) technology has provided an alternative to the incandescent lamp. LED's are often bundled together in a single fixture and oriented to meet the horizontal beam spread required of navigation lights. Current production LED's have a clear plastic encapsulation to protect the individual emitting substrate of the chip. The encapsulation is usually shaped as a convex lens to focus the light from the chip surface into a cone of light. This cone of light has a slight cylindrical divergence about the central axis. Thus the beam spread is fairly narrow. Therefore, several LED's need to be ganged together like knuckles on a clenched fist so that each LED element can broadcast outwardly over a fairly narrow fan of light, but taken collectively, the total angle is sufficiently wide to meet the horizontal beam spread as required by the Navigation Rules. The use of Light Emitting Diode (LED) technology is becoming popular, however they have a fairly narrow beam spread which is disadvantageous when used in single fixture navigation light systems, but can be advantageous in a navigation light system according to the present invention. Prior art using LED's requires that the individual elements be clustered in a divergent array in order to attain the full horizontal beam spread requirement. Whether the light is incandescent or LED or any other source, it is the wide angle of divergence of the beam spread of prior art lights combined with a bad location of the light fixture that causes glare on the boat and appurtenances.

U.S. Pat. No. 6,637,915 to Von Wolske (hereinafter "Von Wolske '915") describes a system and method that utilizes separate fixtures on the stern light to provide full coverage using two fixtures. This is done to provide full angular coverage around obstructions on the transom like outboard motors and outdrives. Von Wolske '915 also uses two half-angle masthead light fixtures to facilitate mounting on either side of the longitudinal centerline. These two fixtures provide full angle coverage as required of a masthead light.

Conventional sailboats lights show a single masthead light located fairly high on the mast. This high location renders the light rather ineffective because, by nature, people look at the horizon for danger. A light located high on a mast is suitable for high seas operation, but is less than ideal for use on inland lakes surrounded by hills or high banks. The hills or high banks often have house and street lights that tends to confuse the boater and delude him into believing that the masthead light on the sailboat is merely a shore based light and of no consequence. Prior art does not give suitable close proximity warning to an approaching boat.

BRIEF DESCRIPTION OF THE DRAWINGS

The benefits, features, and advantages of a navigation light system according to the present invention will become better understood with regard to the following description, and accompanying drawings where:

FIGS. 16-30 are top views of a boat with a navigation light system according to various embodiment of the present invention.

DETAILED DESCRIPTION

Figure 1:
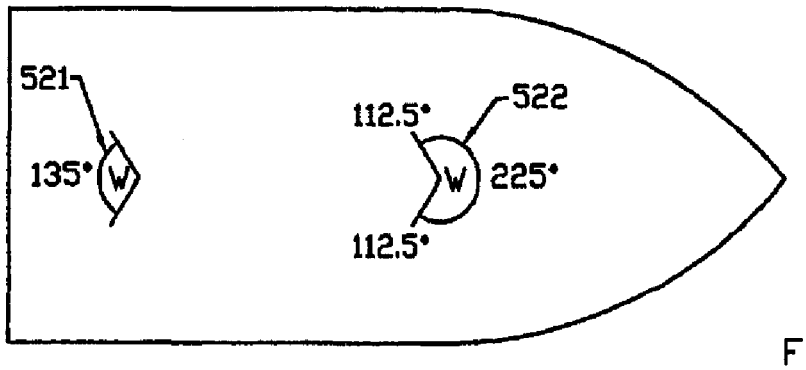
Fig. 1 (Prior Art)
FIG. 1 is a top view of a boat with prior art navigation lights.

The following description is presented to enable one of ordinary skill in the art to make and use a navigation light system according to the present invention as provided within the context of a particular application and its requirements. Various modifications to the preferred embodiment will, however, be apparent to one skilled in the art, and the general principles defined herein may be applied to other embodiments. Therefore, a navigation light system according to the present invention is not intended to be limited to the particular embodiments shown and described herein, but is to be accorded the widest scope consistent with the principles and novel features herein disclosed.

A navigation light system according to various embodiments of the present invention uses multiple partial arc lights (placed near the perimeter) to minimize glare. The navigation lights described herein use multiple partial arc lights (placed near the perimeter) to minimize occlusion. A navigation light system according to various embodiments of the present invention reduces glare while increasing conspicuity. The navigation lights described herein place the navigation lights near the perimeter of the boat to minimize the problems of occlusion of the light beam. The navigation lights described herein are a means to increase the conspicuity of navigation lights. The navigation lights described herein use uses correct spatial separation to ensure visual separation. The navigation lights described herein use white lights closely spaced to colored lights. The navigation lights described herein use bicolor light fixtures with a single lamp and dual colored red and white lenses shining over mutually exclusive horizontal arcs. The navigation lights described herein use bicolor light fixtures with a single lamp and dual colored green and white lenses shining over mutually exclusive horizontal arcs.

The navigation lights described herein use duplex lights of different colors shining over mutually exclusive arcs. The navigation lights described herein use incandescent lamps and LED's. The navigation lights described herein use sailboat guy wires as a mounting location. Boat hull types suitable for navigation lights described herein include, but are not limited to the following: v-hull, catamaran, pontoon, jon boat, barge, houseboat, and sailboat.

A navigation light system according to various embodiments of the present invention recognizes the existence of appurtenances (e.g., accessories and hardware) mounted to the hull of the boat and which are often necessary or convenient for safe and comfortable boating. The appurtenances include the following; t-top, soft bimini, hard bimini, tuna tower, radar arch, water ski arch, wakeboard arch, other perimeter posts, windshield, railing, pulpit and, sailboat mast guy wires. These appurtenances and their sub parts are often the very obstructions that create the problem of glare and occlusion when using prior art lighting for which a navigation light system according to various embodiments of the present invention is a suitable substitute. However, these appurtenances often provide points of attachment for a navigation light system according to various embodiments of the present invention. Ironically, they are part of the problem but are often part of the solution. A navigation light system according to various embodiments of the present invention also recognizes that occupants of the boat are also a source of occlusion. Occupants are often more difficult to design around than the hardware and appurtenances because the people stand up and move about thus blocking the desired light beam from being directed outwardly from the subject boat. On small boats, people often intentionally stand up to block the light to minimize glare on the foredeck. This action blocks the very light needed to warn oncoming boats as part of the conspicuity requirement, but it helps the operator's night vision as part of the proper lookout requirement.

A navigation light system according to various embodiments of the present invention uses spatially separated, piecewise continuous, partial arc white lights as an alternative solution to satisfy the regulatory requirements of a mast head light, or a stern light, or a combination 360 degree all around light. A navigation light system according to various embodiments of the present invention also includes the novel use of spatially separated, piecewise continuous, partial arc colored lights as an alternative solution to satisfy the regulatory requirements of side marker lights. These side marker lights are colored red on the port side of the boat and colored green on the starboard side of the boat. A navigation light system according to various embodiments of the present invention also recognizes that other colors, for example yellow, may be deemed appropriate for certain functions and are included in the scope of the invention.

A navigation light system according to various embodiments of the present invention further includes the novel combination of the above partial arc white lights together with above partial arc colored lights to form mutually exclusive, dual colored light pairs that are spatially separated on the boat. Standard incandescent lamps and Light Emitting Diodes (LED) are suitable for this embodiment. A single lamp with dual colored lenses can also be used.

Duplex lights are typically comprised of two lamps in a single fixture wherein each lamp gives off a different colored light. Duplex lights also include two lamps wherein each lamp is covered by a separate lens of a different color. In a navigation light system according to various embodiments of the present invention the duplex lights are comprised of a white light and a red light, or a white light and a green light.

Bicolor lights have been in use for a long time, but have always consisted of a single lamp covered by a red lens together with a green lens in a single fixture, wherein each lens broadcasts a different color light out over a different horizontal beam sector. Bicolor lights of a navigation light system according to various embodiments of the present invention use a single lamp and are comprised of a white lens and a red lens, or a white lens and a green lens. Of course, a second lamp could be added in the same vertical plane for redundancy, but it is still within the scope of present invention.

One advantage of these arrangements is that the navigation lights can be placed around the perimeter of the boat or can be placed on raised structures common on the boat to eliminate excessive glare and, or, eliminate light occlusion caused by the very presence of said raised structures.

A navigation light system according to various embodiments of the present invention recognizes that these lights can also be considered as accessory lights. This is because a light that is considered to be a "navigation" light by some organizations is not necessarily a "navigation" light to others. Therefore, these lights can generally be referred to as "accessory" lights because they are not yet allowed as an acceptable alternative light to the required "navigation" lights as specified by the regulatory authorities. A navigation light system according to various embodiments of the present invention is an improvement over prior art required navigation lights and may be used simply as a supplementary light in addition to the Coast Guard mandated lights. But the navigation light system described herein may also be used as "accessory lights" no different than party lights common to so many boats as long as they do not interfere with the performance of the officially prescribed lights of the Navigation Rules. This is similar to the paradox faced by the third taillight on automobiles. In those early years, it was not officially a taillight until it was deemed as such by the Government, until then, it was simply an accessory light.

One important benefit of a navigation light system according to various embodiments of the present invention is to ensure the necessary visual separation of the different navigation light types when viewed from any horizontal direction by the correct use of sufficient spatial separation of multiple lights. Multiple partial horizontal arc sector lights are placed at multiple, spatially separated, locations to avoid occlusions and reduce glare and therefore allow the use of brighter lights. Spatial separation of multiple lights also overcomes the problem of occlusion of the light beam caused by the various and necessary hardware located on a boat. This problem is overcome by now having the freedom to locate the individual lights where both glare problems and occlusion problems are minimized while still maintaining the visual separation and color distinction of the red and green lights from the white lights.

A navigation light system according to various embodiments of the present invention is optically, hence functionally, equivalent to the required navigation lights but are constructed and arranged differently from prior art lights. This equivalency is the basis for a navigation system according to embodiments of the present invention and will be shown in the figures. Based on the Coast Guard acceptance of using a single 360 degree light to be functionally equivalent to a 225 degree masthead light plus a 135 degree stern light, the converse must also be true. Therefore, if it is true for that specific case, it must be true for any other light in which the single light can be replaced by multiple lights with contiguous beam spread patterns. The Coast Guard also allows that the multiple lights comprised of the 225 degree masthead light and the 135 degree stern light can be spaced separately from each other and still serve the same function. The three arrangements are functionally equivalent because they are optically equivalent.

A navigation light system according to various embodiments of the present invention separates the masthead light, the red and green side marker lights, the stern light, and the 360 degree light into multiple partial arc segments and locates them spatially separated along the perimeter of the boat. A navigation light system according to various embodiments of the present invention anticipates the realities of optics and the tolerance limits on mounting light fixtures and allows for some overlap of the light beam from one light to another nearby light. Some overlap is better than no overlap. No overlap would leave a blank portion of the desired continuous presentation of the light. This blank portion would be just as bad as having an occlusion. However, the overlap is advantageous in that it is like having a redundant light. Even using two full horizontal sector lights is anticipated by a navigation light system according to various embodiments of the present invention and is not prohibited by the Navigation Rules. The disadvantage is that two redundant lights use excess power and may cause excessive glare.

A navigation light system according to various embodiments of the present invention also contemplates multiple redundant installations of full horizontal sector navigation lights to be mounted on boat hulls that are large enough to accommodate the installations and still maintain the required visual separation as mandated by the Navigation Rules.

Excessive glare problems are minimized by the use of lights that have a limited partial arc of emission. This means that the narrow beam of light can be directed more straight out from the boat, which in turn, limits the amount of fugitive light that is emitted to the side of the beam to cause glare.

Each partial arc segment may be as little as 30 degrees when using LED's to as much as 180 degrees when using two halves of a 360 degree light. The only real hard limits are the forward and back angle cutoffs of 112.5 degrees for the red and green lights, and these are regulatory constraints. Even the back angle cutoff for the white lights becomes irrelevant from the standpoint of the optics and physics of the lights because all white lights are optically and functionally equivalent as per the above discussed interchangeability allowed by the Coast Guard.

Because the white lights have so many names, and they can be subdivided per a navigation light system according to various embodiments of the present invention, and they can be mounted at numerous locations about the boat and on the numerous appurtenances, the lexicon becomes difficult. For example, if the 360 degree white light is divided into two halves, either longitudinally or transversely to the boat, it still serves the role of a white light visible from any direction, but now it looses its name identity. And if the white light is divided into partial arc segments as small as 30 degrees, it further looses its identity and therefore, assigning a specific name to each partial arc light is meaningless and burdensome. Each light is still a partial arc, spatially separate, light. Any and all of these white lights can be called partial arc white (paw) lights.

Similarly, if a red side marker light is subdivided into two, or even three or four separate lights as with LED's, each segment still serves the role of a red light. There is no real distinction in its function from the sister segment of the same color. Therefore, all of these red lights can be called by one name, partial arc red (par) lights. Similarly, all of the green lights can be called partial arc green (pag) lights. And generally they are referred to as partial arc colored (PAC) lights because they both have the same sector requirement, just different colors for different sides of the boat.

A navigation light system according to various embodiments of the present invention contemplates that a given navigation light can be divided into two or more separated lights and located such that the glare and occlusion problem can be greatly reduced while increasing, or certainly maintaining, conspicuity. A navigation light system according to various embodiments of the present invention also contemplates redesigning a given navigation light fixture into multiple fixtures such that the multiple fixtures can be located and installed in a fashion to minimize glare while still maintaining, in total, the necessary horizontal arc of light as dictated by the Navigation Rules. These multiple fixtures can or will have a reduced horizontal arc of light to reduce glare from reflections off of the surrounding appurtenances on the boat. These multiple fixtures are located to present an image to a distant observer, of a piecewise continuous presentation of the desired color of the specific navigation light.

The advantage of using two similar light fixtures mounted at a spatially separated distance is that this arrangement prevents the simultaneous occlusion of the lights as seen by a distant observer. It is disclosed that the two separate fixtures could be full horizontal beam spread fixtures. The disadvantage of using two full spread fixtures is that the overlapping horizontal light beams which strike surrounding objects contributes to the glare problem and also may tend to confuse a distant observer by the presentation of two lights of similar expression. This disadvantage can be overcome by using partial arc light fixtures.

Because of the three dimensional, curvilinear nature of a boat, it is contemplated that the partial arc fixtures are mounted in a spatially separated fashion around the perimeter of the boat. It is also contemplated that two different types, or colors, of lights located in close physical proximity will show in two different directions such that a distant observer can see only one of the colors at a time. In other words, the horizontal sectors are mutually exclusive such that as one light fades from the vision of an observer, the other sister light seems to appear. This is like the red and green bicolor light at the bow of a boat.

A navigation light system according to various embodiments of the present invention has particular utility for smaller boats that do not have enclosed cabins, wherein the display of prior art navigation lights causes glare on the hull or its appurtenances. This glare is particularly hard to suppress if the navigation lights have a full horizontal beam sector as indicated in the suggested application diagrams of the regulatory agencies, for example, American Boat and Yacht Council; Section A16.

Current Navigation Rules require that the included horizontal angle of the red side marker light encompasses from dead ahead, or zero degrees, and extends back on the port side of the boat to 112.5 degrees from the dead ahead bearing. The green side marker light has the same angular requirements, but to the opposite, or starboard side. In a navigation light system according to various embodiments of the present invention, each of these side marker lights is configured to have half of the full horizontal sector, for example, 56.25 degrees, and each is mounted and oriented correctly so that when viewed from a distance, the pair appears to present a full horizontal sector with minimal overlap. Then the two lights can be mounted at some reasonable spatial separation while still providing full horizontal sector coverage in a piecewise continuous presentation to an observer. The same logic applies to the left half side of a masthead light. That is to say, it also can be configured as two separated fixtures, each oriented to present its respective half sector coverage to an observer. If the fixtures of the red lights are spatially separated and paired with a white light that presents a horizontal half sector opposite to the red half sector, then the red color does not merge with the white color and there is good visual separation of the two colors as intended by the Navigation Rules. The same characteristics apply to the green and white lights, but they are on the starboard side of the boat.

A distant observer located dead ahead of the subject boat sees a masthead light expressed as one or two white lights near the centerline of the boat. On the port side of the boat, there is a red side marker light, and on the starboard side of the boat is a green side marker light. Each side marker light is set considerably off to the side from the centerline. The red side marker appears to be mounted on the port side along the edge of the boat. The green side marker appears to be mounted along the edge on the starboard side of the boat. Each of these colored lights emits light over a horizontal sector of 56.25 degrees, but they are arranged to shine in different directions. As the observer circles to pass on the port side of the boat, the forward white light near the bow is visible from zero degrees back to 56.25 degrees at which point, it tends to visually fade out of view, and is replaced by a different white light located considerably rearward, yet along the port side rail. This second white light is visible from 56.25 degrees back to 112.5 degrees. Thus these two white lights provide continuous coverage from dead ahead to a back angle of 112.5 degrees. Simultaneously, the first visible red side marker light is mounted considerably back from the bow and along the edge of the boat, but is pointed towards the front of the boat and is visible from zero degrees to a back angle of 56.25 degrees. The second visible red side marker light is mounted at the bow, but is pointed out to the side of the boat. Thus, the bow mounted white light and the side-mounted red light are both pointed in the same direction towards the front and are simultaneously visible, but they are visually and spatially separated from each other. Furthermore, the side mounted white light and the bow mounted red light are both pointed off to the side and are simultaneously visible when viewed from the side. As one red and white display tends to fade out of view at a 56.25 degree back angle, it is replaced by a second red and white display visible from 56.25 degrees to a 112.5 degree back angle. The second red light is usually mounted near the bow and fairly close to the first white light thus forming a pair of lights, but the pair have different color and different horizontal beam sector orientations which are mutually exclusive. The other pair of red and white lights are similarly located close to each other and they also have mutually exclusive horizontal sector orientations, but they are mounted considerably back from the bow, and have the converse horizontal beam sectors of the first pair of lights. The visual effect is that the lights that were first visible, in this example, white in front and red to the rear, have magically turned off and another pair of lights, red to the front and white to the rear, has magically turned on. This is just an illusion caused by the passage of the observer beyond the horizontal cutoff angle of 56.25 degrees. A similar presentation of green and white lights is visible as an observer passes along the starboard side of the boat. This will be shown in the figures.

In the above embodiment the transition occurs at approximately 56.25 degrees to the left of dead ahead. That is to say, an oncoming observer sees a bow mounted white light and rearward mounted red light located off to the side of the white light. As the observer passes the 56.25 degree point of heading, the bow mounted white light appears to turn red and the red rearward mounted light appears to turn white. The observer always sees a red light visually separated from a white light.

For this discussion, it is assumed that the boat is a V-hull pleasure boat about 20 feet long and 8 feet wide as common to the industry. This boat is fitted with red, green, and white lights. On the port side of the boat, there are two, not just one, red lights. Also, on the port side there are two, not just one, white lights. Conversely, on the starboard side, there are two green lights and two white lights. On the port side, one red light and one white light are grouped as a pair and located near the bow and slightly to the left of center. Also, on the port side, but farther back and along the edge of the boat is another pair of red and white lights. The starboard side has a converse grouping of two pairs of lights that are similarly located. One pair consisting of a green and a white light is located near the bow slightly off the centerline. Another pair consisting of a green light and a white light is located farther back and along the edge of the boat. An observer viewing the starboard side of the subject boat will always see at least one green light and at least one white until he gets past the 112.5 degree point, at which time the green light disappears.

As the observer continues towards the rear of the boat and goes past the 112.5 degree point, the red light disappears and the white light will disappear and hand off its role to the white stern light. If the white light is configured as a 360 degree, all around white light, it will retain its identity and presentation.

If an observer passes the starboard side of the boat, the explanation is the same except the green light takes the place of the red light.

The cutoff angle of 56.25 degrees is arbitrary and could be any angle less than 112.5 degrees. A paw or a par with 40 degrees or even 30 degrees would still work as well as the 56.25 degrees, it would just take more pairs of lights to add up to the total of 112.5 degrees. This will be shown clearly in the various embodiments of a navigation light system according to various embodiments of the present invention.

A navigation light system according to various embodiments of the present invention contemplates the use of fixtures with a narrower horizontal beam spread than commercially available and the combined use of multiple fixtures spatially separated by an appropriate distance and location on the boat and oriented in an appropriate direction outwardly from the craft. This method reduces glare and therefore allows the use of brighter lights thus increasing the conspicuity of the subject boat as perceived by a neighboring boat. This arrangement allows an operator to more effectively see and be seen.

To minimize gaps in the coverage that will look like occlusion to a distant observer or a neighboring boat, the subject boat has the lights displayed with some overlap in the horizontal light beams, yet not so much overlap so as to cause confusion or glare.

A navigation light system according to various embodiments of the present invention contemplates the use of LED's. Current production LED's have a rather narrow angle of divergence of the emitted light. For example, if the angle of divergence is 30 degrees, then the installation will require at least four separate LED's to yield a full sector presentation of 112.5 degrees, with some allowances for a slight overlap, yet this installation will still provide a distinct light cutoff on the forward and rear end of the required total horizontal sector.

Red LED's can be paired with white LED's as in the above example and be located spatially close to each other while presenting visual separation if oriented in different directions. The same applies to green and white pairings.

The requirement of so many LED's is not particularly onerous because they are so compact, they use so little power, they are robust, they are waterproof, and they last for a very long time. Boat manufacturers can integrate the location and orientation of the LED's as part of the original design for a sleek, low maintenance installation. A preferred location is along the shear line of the boat, and can be mounted flush or even recessed into the outside surface of the hull.

Sailboats also include the use of a navigation light system according to various embodiments of the present invention including lights attached to the guy wires or cables holding the mast in the upright position. These wires are often referred to as "stays". This arrangement allows the mounting of the lights further out towards the perimeter of the boat at a location where the fugitive light rays are less likely to cause glare to an operator. A navigation light system according to various embodiments of the present invention includes a torsion resisting means to prevent a fixture from rotating when mounted to a mast guy wire or stay.

FIG. 1 through FIG. 30 show only the top view of a typical boat. The bow end is depicted as the pointed end and the stern end is depicted as the blunt end. FIG. 31 through FIG. 51 shows three views, including top (T), side (S) and front (F) or rear (R), of a given boat. FIGS. 58-61 is a legend showing what the symbols for each of the light fixtures actually means with respect to the angle of emission. As used in the Figures, white lights are labeled "W" and colored lights are labeled according to their color, including green lights labeled "G" and red lights labeled "R". Selected lights are further labeled with a horizontal beam sector in degrees (e.g., 225°) between cutoff lines. Also, selected cutoff lines are labeled in degrees relative to a zero degree forward direction.

FIG. 1 shows prior art lighting on a boat with a bow end, depicted as the pointed end, and a stern end, depicted as the blunt end, showing required prior art "masthead light" 522 emitting white light (labeled "W") towards the front end, or bow, of the boat. The masthead light 522 has a specified horizontal beam sector of 225° (from a first cutoff line of 112.5° starboard side relative to zero degree straight ahead to 112.5° port side relative to the zero degree straight ahead). Other lights are similarly labeled throughout the Figures. This light emits lights over a horizontal angle of 225 degrees centered about the straight ahead, forward direction, and continues back around to both the port side and the starboard side to a back angle of 112.5 degrees. A second light called a "stern light" 521 is located towards the rear end or stern end of the boat. This prior art stern light is required to be white (labeled "W") in color and of certain minimum brightness and emits light over a horizontal angle of 135 degrees centered about the straight rearward direction, and continues forward around toward the front of the boat to a back angle of 112.5 degrees on both the port side and the starboard side and stops at the same angle as the masthead light. This arrangement is the base requirement for navigation lights for all boats.

Figure 2:
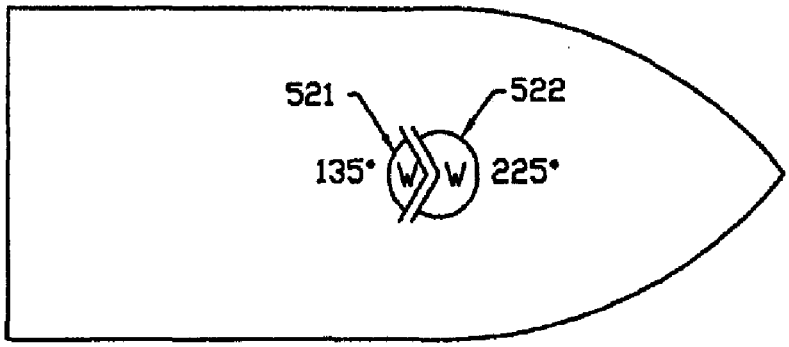
Fig. 2 (Prior Art)
FIG. 2 is a top view of a boat with prior art navigation lights.

FIG. 2 shows prior art of a similar boat showing a permitted arrangement of navigation lights comprised of a masthead light 522 and a stern light 521 wherein both lights are typically both mounted to the same support pole. These separate lamps are commercially available as mounted in one fixture. This arrangement is permitted because it is considered by the regulatory authorities to be the optical equivalent of FIG. 1.

Figure 3:
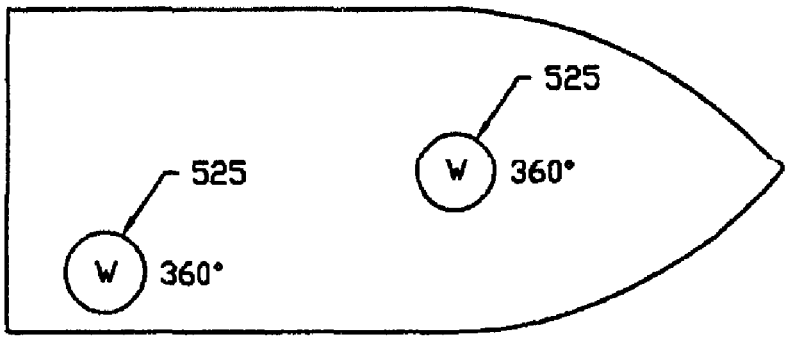
Fig. 3 (Prior Art)
FIG. 3 is a top view of a boat with prior art navigation lights.

FIG. 3 shows prior art of a similar boat showing another arrangement of navigation lights wherein the masthead light and the stern light are consolidated into a single light 525 and emits light over a 360 degree horizontal arc. This arrangement is permitted by the regulatory authorities because it is considered to be the optical equivalent of both FIG. 1 and FIG. 2. This arrangement allows the light to be located at the center of the boat or at the stern end and offset to one side) and is commonly found on small recreational boats having a length of less than 12 meters. This light is referred to as a "360 degree light" or "all around light" 525.

This optical equivalence is because at any given location at the distant horizon, an observer can see only one light, either the masthead light or the stern light. Only at the back angle of 112.5 degrees could an observer see both the masthead light and the stern light simultaneously and that would be only for narrow limits if the masthead light spills light rearward of the 112.5 degree cutoff angle and, or, the stern light spills light forward of the 112.5 degree cutoff angle. Hence, if the observer can only see one light at a time, it doesn't matter which light he sees. Also, it is known from solid geometry that an observer cannot distinguish the orientation of the subject boat by seeing a white light or even if the observer sees two, or more white lights. Party boats often have many white lights visible and that is permissible as long as the boat has a light visible and it meets the requirements of the Navigation Rules. The requirement of having "a light visible" means that at least one light must be visible, hence two or more lights are also permissible. The orientation of the subject boat is determined by the use of red and green side marker lights that are also mandated by the Navigation Rules.

There are several objectives of a navigation light system according to various embodiments of the present invention. One objective is to minimize glare in the subject boat by locating these lights at the perimeter of the boat. The other objective is to minimize occlusion of the lights on the subject boat as viewed by a distant observer. Subdividing the mandated white navigation lights and locating these lights at the perimeter of the boat and away from objects in the subject boat accomplishes both objectives. A navigation light system according to various embodiments of the present invention presents a novel use of spatially separated, piecewise continuous, partial arc white lights to satisfy the regulatory requirements of a mast head light, or a stern light, or a combination 360 degree all around light.

Figure 4:
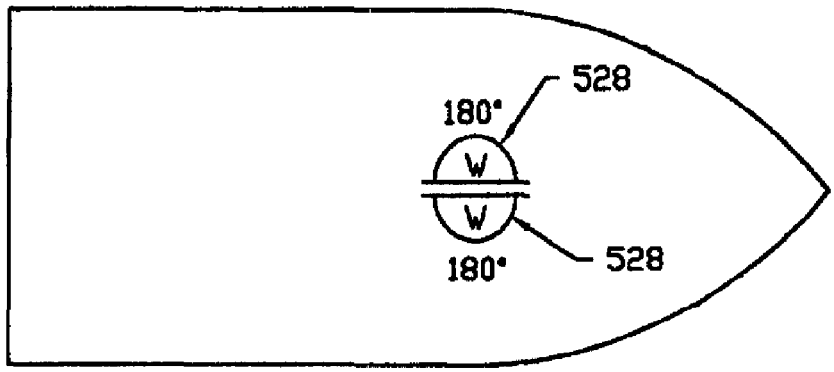
FIG. 4 is a top view of a boat with a navigation light system according to an embodiment of the present invention.

FIG. 4 shows a navigation light system according to an embodiment of the present invention on a boat with a pair of white lights 528 mounted to a single location point but comprised of two similar lights each having an emission angle of 180 degrees. This arrangement is optically equivalent to the arrangement shown in FIG. 2 or FIG. 3. This equivalency is based on the same logic that is used by the regulatory agency that permits FIG. 3 or FIG. 2 to be used in lieu of FIG. 1 as an equivalent use. This light is a half all around light 528.

Figure 5:
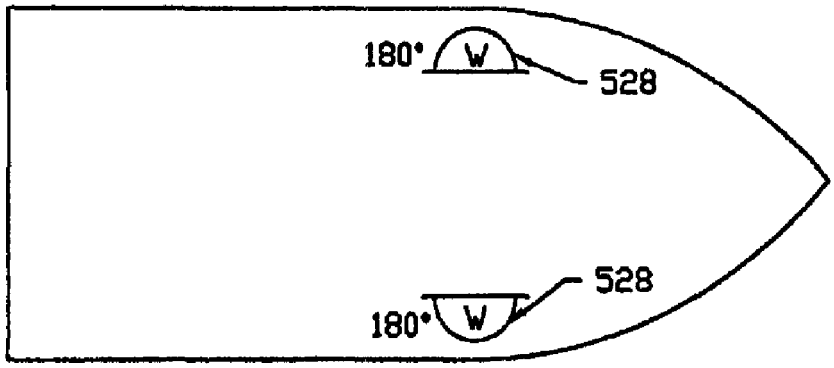
FIGS. 5 and 6 are top views of a boat with a navigation light system according to various embodiments of the present invention.

FIG. 5 shows a navigation light system according to an embodiment of the present invention on a boat with the same lights of FIG. 4 except the two half all around lights 528 are spatially separated on the port and starboard sides of the boat. Using the same logic of the regulatory authorities that FIG. 2 is optically equal to FIG. 1, it can be argued that FIG. 5 is optically equivalent to FIG. 4. The only difference is that the spill over angle of the lights is not at 112.5 degrees as shown in FIG. 1 and FIG. 2, but now the spill over angle is straight ahead at zero degrees and straight rearward at 180 degrees. But once again, the principals of solid geometry dictates that an observer who can see one or two lights cannot tell anything about the orientation of the subject boat without knowing anything more about the boat. Orientation of the boat is determined by the display of the red and green navigation lights.

Figure 6:
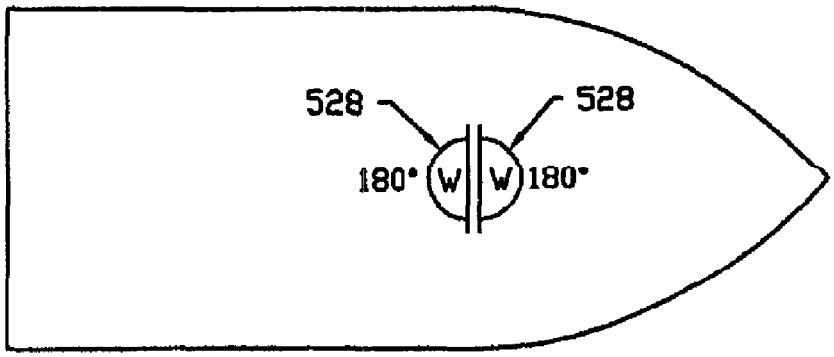

FIG. 6 shows a navigation light system according to an embodiment of the present invention that is similar to FIG. 4 that is similar to FIG. 2 except the split angle orientation is different, yet they are optically equivalent to a distant observer. If the two halves of the light in FIG. 6 are spatially separated to the front half and rear half of the boat, they will be optically equivalent to FIG. 1, except the split angle is now at 90 degrees back angle. But once again, solid geometry dictates that by observing one or two points of light at a distance does not lend any information about the size or orientation of the subject boat if one does not know more information about the boat. It is like trying to discern the spatial orientation, size, and distance of two stars viewed in a dark sky. It is not possible.

Figure 7:
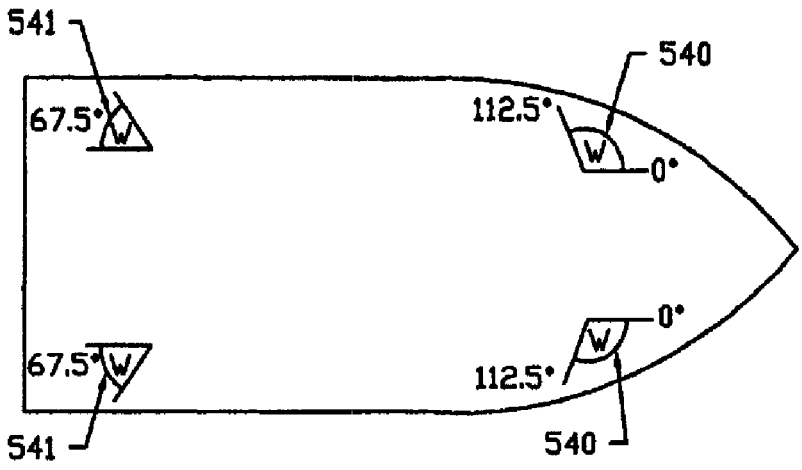
FIG. 7 is a top view of a boat with navigation lights according to Von Wolske '915.

FIG. 7 shows a boat with white lights according to Von Wolske '915. Note that an observer sees two white lights 540 when he is straight ahead of the subject boat and likewise the observer sees two white lights 541 when he is straight rearward of the subject boat. Again, this does not cause confusion, it is simply two white lights as viewed by a distant observer. Optically, it is no different from the back angle of FIG. 1.

Figure 8:
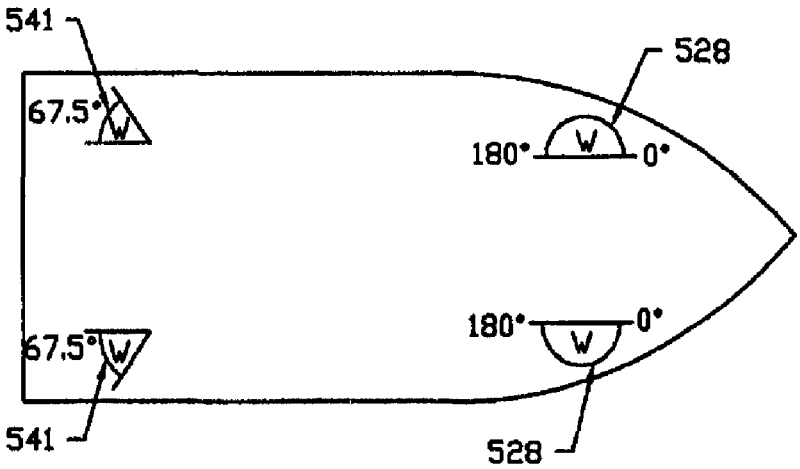
FIGS. 8-14 are top views of a boat with a navigation light system according to various embodiments of the present invention.

FIG. 8 shows a navigation light system according to an embodiment of the present invention on a boat similar to FIG. 7 except the front white lights are the half all around lights 528 of FIG. 5 and have a back angle greater than 112.5 degrees as required by the Navigation Rules. Using this arrangement, an observer will see two white lights when he is at a location rearward of the back angle of 112.5 degrees and will continue to see two lights all the way back to straight rearward of the boat. When the observer is straight rearward of the subject boat, the observer will see four white lights for a brief moment until he shifts to the other side of the subject boat longitudinal centerline. Once again, the fact that a distant observer can see one, two, three, or four white lights does not add to, nor subtract from the observers inability to discern the orientation of the subject boat. The display of multiple lights simply adds a source of redundancy and safety to the subject boat.

Figure 9:
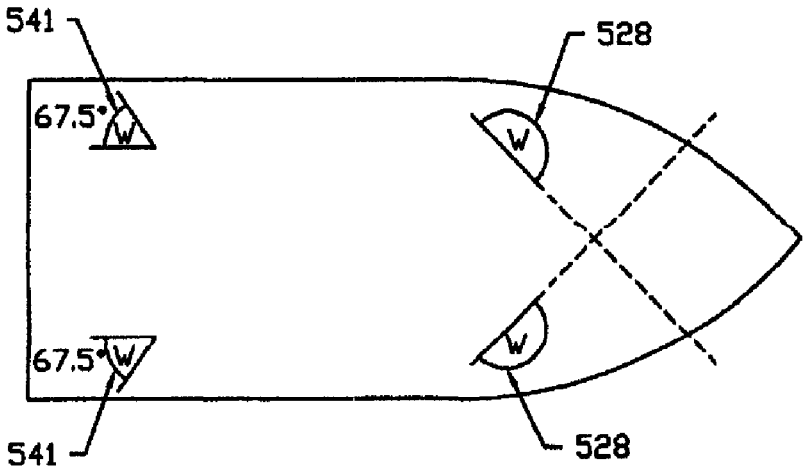

FIG. 9 is similar to FIG. 8 except the half all around lights 528 are mounted to be angled inward towards the boats longitudinal centerline such that the back rearward cutoff angle is similar to FIG. 7. A distant observer will see two white lights when viewing the subject boat from straight ahead to a side angle of 67.5 degrees to either side of the longitudinal centerline. Once again, the fact that the distant observer can see two white lights does not add to, nor subtract from the observers inability to discern the orientation of the subject boat. This arrangement tends to preserve the desired back angle of light cutoff of 112.5 degrees as mandated by the Navigation Rules.

Figure 10:
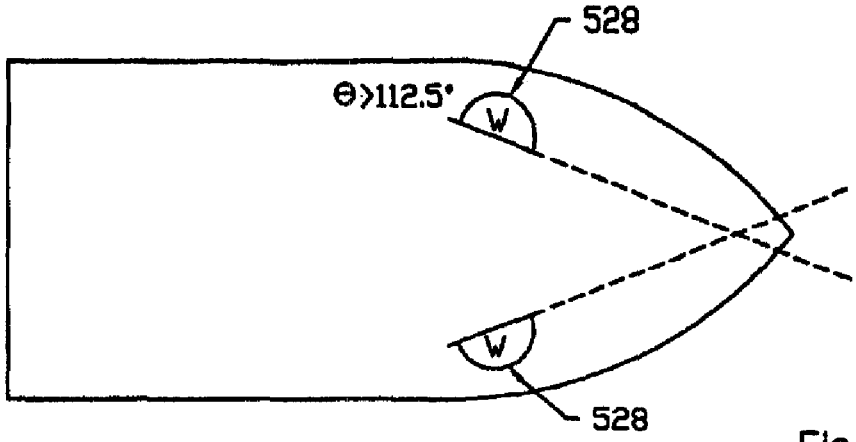

FIG. 10 is similar to FIG. 9 except the half all around lights 528 are angled inward to a lesser amount and therefore have a larger back angle than the 112.5 degrees of FIG. 9. This arrangement decreases the amount of glare on the front of the boat and allows for a narrower stern light. This arrangement also lends itself to a better installation on some of the appurtenances commonly found on boats as shown in later figures.

Figure 11:
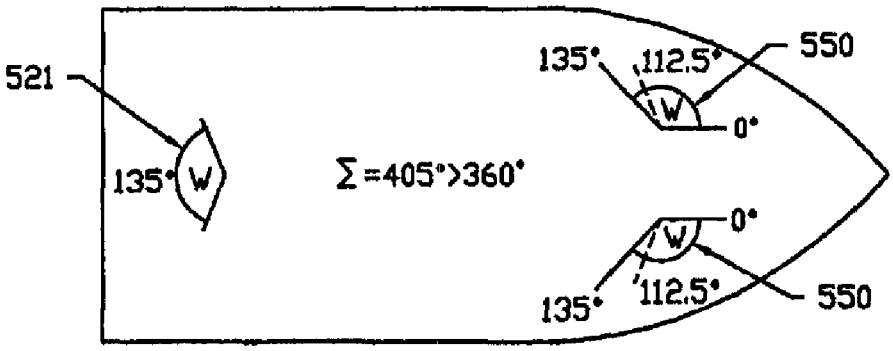

FIG. 11 is similar to prior art of FIG. 7 except the two front mounted, partial arc white 550 lights each have a total included angle of 135 degrees. This angle is standard for commercially available white stern lights 521. This embodiment shows a boat with three commercially available white stern lights installed using two of the fixtures as half masthead lights. This combination of lights satisfies the minimum back angle requirements of a masthead light and in fact exceeds the minimum back angle by 22.5 degrees. A distant observer will see two white lights when located at an angle between 112.5 degrees and 135 degrees on either side of the subject boat. The total included angle of the three fixtures when added together is three times 135 degrees and equal to 405 degrees. Once again, the fact that a distant observer sees two white lights is immaterial to the observer's inability to discern the orientation of the subject boat.

Figure 12:
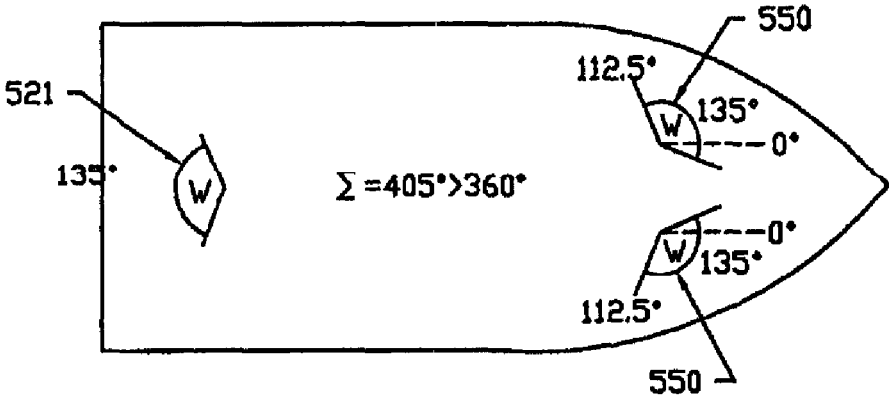

FIG. 12 is similar to FIG. 11 except the two front white lights are angled inward by 22.5 degrees towards the longitudinal centerline of the boat. A distant observer will see two white lights from the straight ahead position to an opposite side back angle of 22.5 degrees on either side of the centerline. The distant observer will see only one white light on the subject boat when beyond the angle rearward of 22.5 degrees on either side of the subject boat. The total included angle of the three fixtures when added together is three times 135 degrees and equal to 405 degrees. Once again, the fact that a distant observer sees two white lights is immaterial to the observer's inability to discern the orientation of the subject boat.

Figure 13:
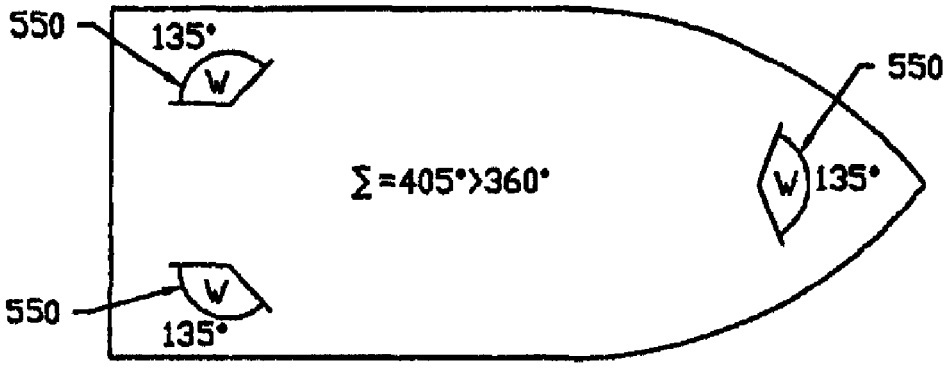

FIG. 13 is similar to FIG. 11 and FIG. 12 in that it uses three commercially available stern lights each with an included angle of 135 degrees. In this configuration, the white lights take on the role of partial arc white lights 550. Thus, the total included angle of the three fixtures is 405 degrees that can be distributed with slight overlap as desirable. One advantage of FIG. 13 is that the two separate stern mounted lights accommodate the use of an outboard motor without occlusion of the light as seen by a distant observer. Another advantage of FIG. 13 using the single front mounted white light is that the back angle is limited to 67.5 degrees to minimize light scatter and glare from the front deck of the subject boat. This back angle is considerably less that the standard 112.5 degrees as required by the Navigation Rules. However, this embodiment still allows for a white light to be seen at all times by a distant observer of the subject boat.

Figure 14:
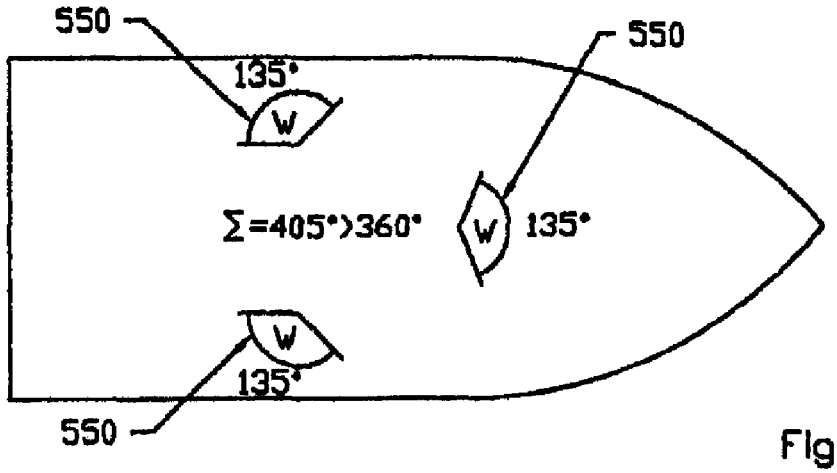

FIG. 14 is similar to FIG. 13 but shows the individual lights located somewhat inward from the perimeter of the boat. This embodiment lends itself to boats that have a roof structure over the heads of the boat occupants, to which the lights are affixed. This roof can be configured as a bimini top, a tuna tower, a soft top, a water ski towing tower, or any of several appurtenances common to boats. Front and side views of this embodiment are shown in later figures.

Figure 15:
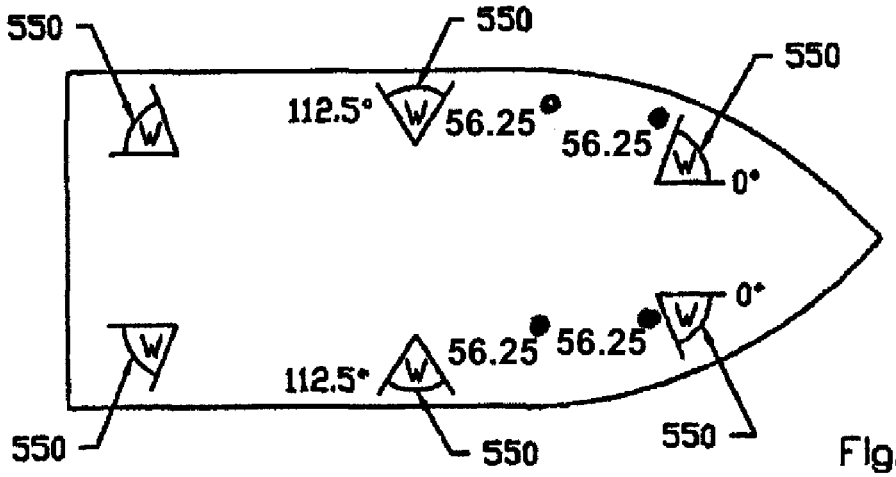
FIG. 15 is a top view of a boat with navigation lights according to Von Wolske '915.

FIG. 15 shows how the front white lights according to Von Wolske '915 as seen in FIG. 7 can be subdivided into spatially separated, piecewise continuous, partial arc white (paw) lights. These partial arc white lights 550 are placed at the perimeter of the boat at a location to avoid glare as seen by an operator of the subject boat and to avoid occlusion of the emitted light as seen by a distant observer. This arrangement shows a white light to a distant observer at any position from dead ahead (at zero degrees) to a back angle of 112.5 degrees. When the observer passes the half angle point (of 56.25 degrees), the white light seems to magically move from the front of the boat to the mid ship position, but the observer still sees a white light. The apparent move or change of light occurs because the two partial arc white lights have mutually exclusive horizontal sectors. Mutually exclusive means that there is no substantial overlap of emitted light between the two lights, so that as the angle of the observer changes, one light becomes visible while the other becomes masked. Similar half angle stern lights are shown at the stern of the boat.

FIG. 16 is similar to FIG. 15 except the front two lights are brought closer together. This closer position is useful for increasing the required visual separation of the white lights from the colored lights. This will be apparent in later figures.

FIG. 17 is similar to FIG. 16 except the front two lights are consolidated into a single partial arc light. The single light costs less, but sacrifices the added safety of the partial redundancy of FIG. 16.

FIG. 18 shows a display of the same lights of FIG. 15 except they are in swapped positions. This arrangement shows a white light to a distant observer at any position from dead ahead to a back angle of 112.5 degrees. When the observer passes the half angle point, the white light seems to magically move from the mid ship position of the subject boat to the front of the boat, but the observer still sees a white light. FIG. 15 and FIG. 18 are optically equivalent to each other.

Figure 19:
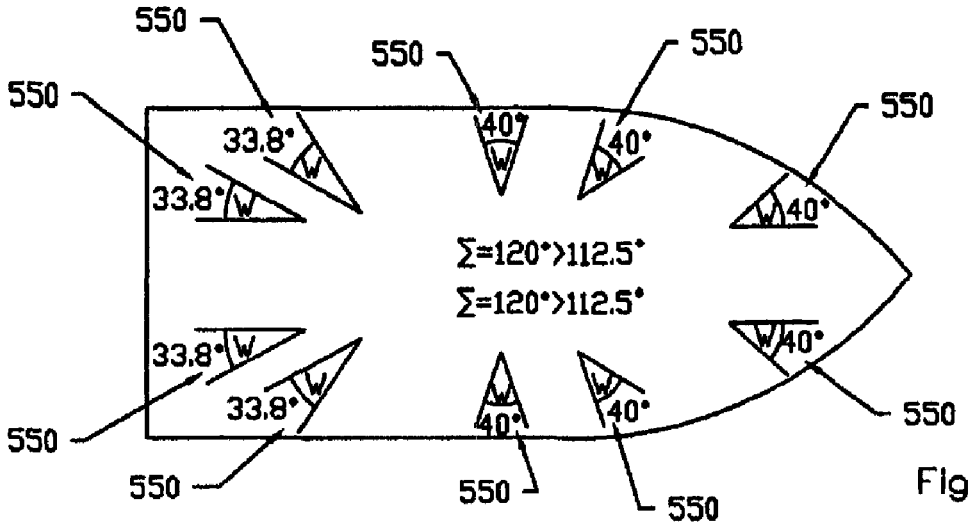

FIG. 19 shows a series of spatially separated, piecewise continuous, partial arc white lights 550 arranged around the perimeter of the boat. The front three lights on each side have an included angle of 40 degrees for a total of 120 degrees that exceeds the required 112.5 degrees of a masthead light. The rear pair of lights on each side also covers a horizontal angle of 67.5 degrees. This is not a problem for a distant observer because he still sees a white light at any angle and is optically equivalent to FIG. 1, or FIG. 2, or FIG. 3. This arrangement is suitable to lights with a narrow angle of emission, for example LED's or deeply recessed incandescent lamps.

Figure 20:
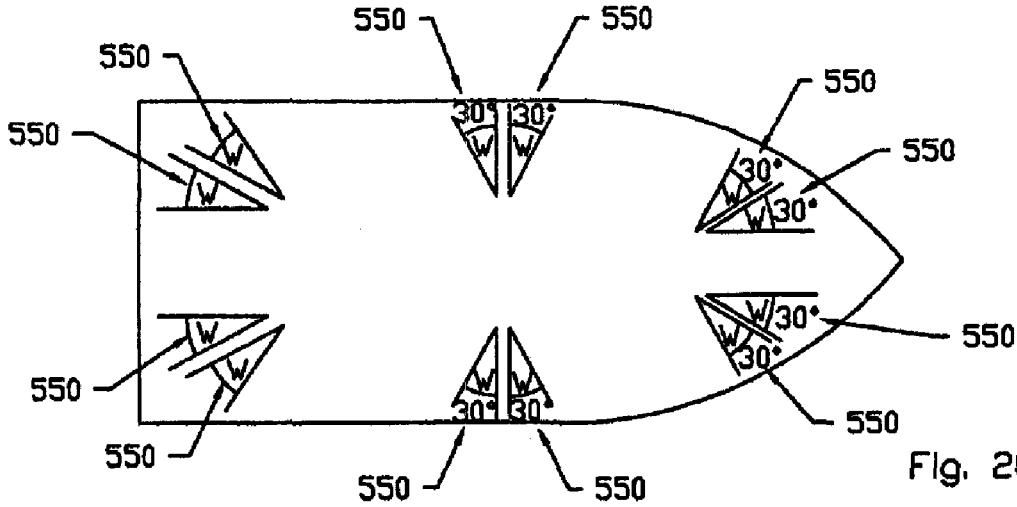

FIG. 20 shows a series of lights similar to FIG. 19 except the lights are paired in a novel fashion that lends itself to current production LED's that commonly have an integral lens on the microchip that limits the beam spread to a cone of 30 degrees total included angle. The front lights of FIG. 20 are similar to the front lights of FIG. 15 except the lights of FIG. 20 are actually comprised of two closely spaced lamps in the same or separate fixtures. Similarly, the middle lights on each side of the boat are comprised of a pair of lamps each with a horizontal beam spread of 30 degrees. And also similarly, the rearward lights on each side of the boat are actually comprised of a pair of lamps each with a horizontal beam spread of 30 degrees. This arrangement displays a white light to a distant observer and is the optical equivalent of FIG. 1. This arrangement will also be applied to the colored side marker lights.

Figure 21:
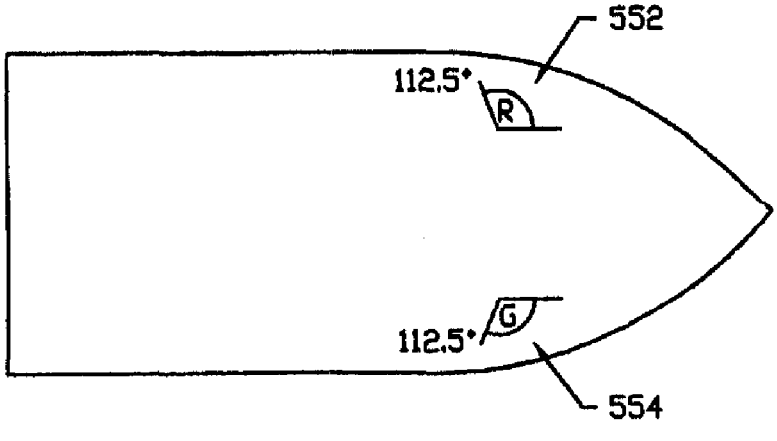

FIG. 21 is prior art of colored side marker lights. Red lights 552 are displayed on the port side and green lights 554 are displayed on the starboard side of the boat. Each of the colored lights is required to shine outward from dead ahead to a back angle of 112.5 degrees.

Figure 22:
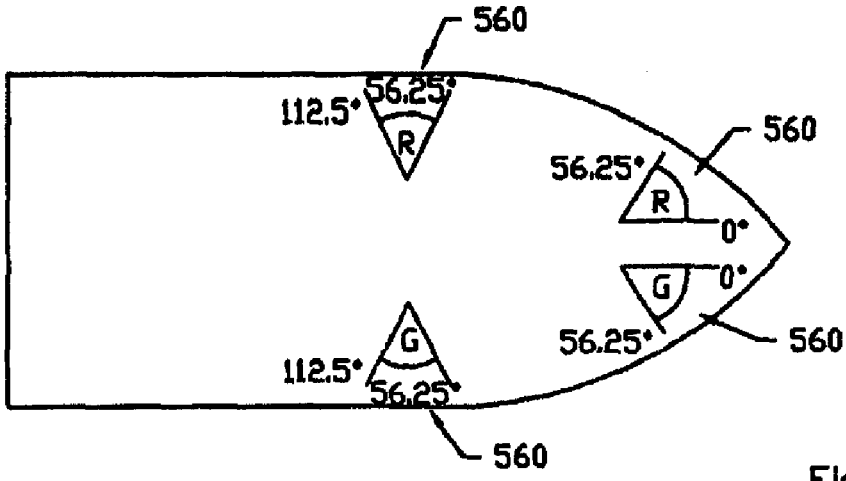

FIG. 22 is a novel display of the colored side marker lights comprised of spatially separate, piecewise continuous, partial arc colored lights 560. FIG. 22 is optically similar to FIG. 15 in that the display as seen by a distant observer is similar except the colors are red on the port side and green on the starboard side of the subject boat. This arrangement shows a colored light to a distant observer at any position from dead ahead at zero degrees to a back angle of 112.5 degrees. When the observer passes the half angle point of 56.25 degrees, the colored light seems to magically move from the front of the boat to the middle of the boat, but the observer still sees a colored light. Again, this change of roles is because the partial arc colored lights have mutually exclusive horizontal sectors in which there is no substantial overlap of emitted light between the two lights. FIG. 22 is very similar to FIG. 15, except FIG. 22 has colored lights and FIG. 15 has white lights.

Figure 23:
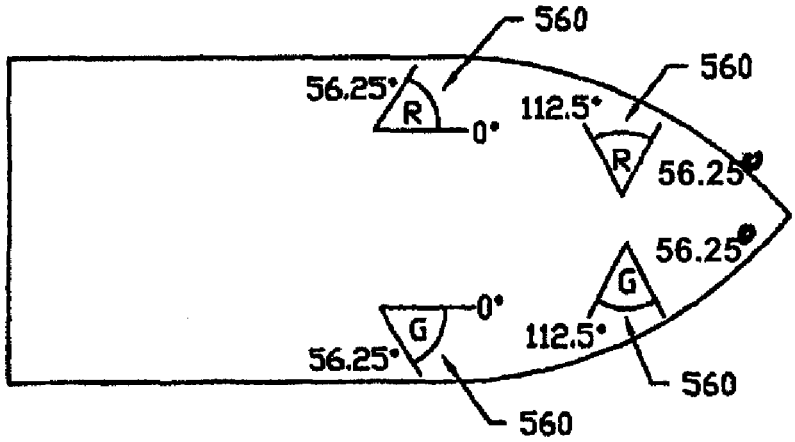

FIG. 23 is similar to FIG. 22 except the light positions are swapped. FIG. 23 compares to FIG. 18 as FIG. 22 compares to FIG. 15. The lights of FIG. 23 have mutually exclusive horizontal sectors.

Figure 24:
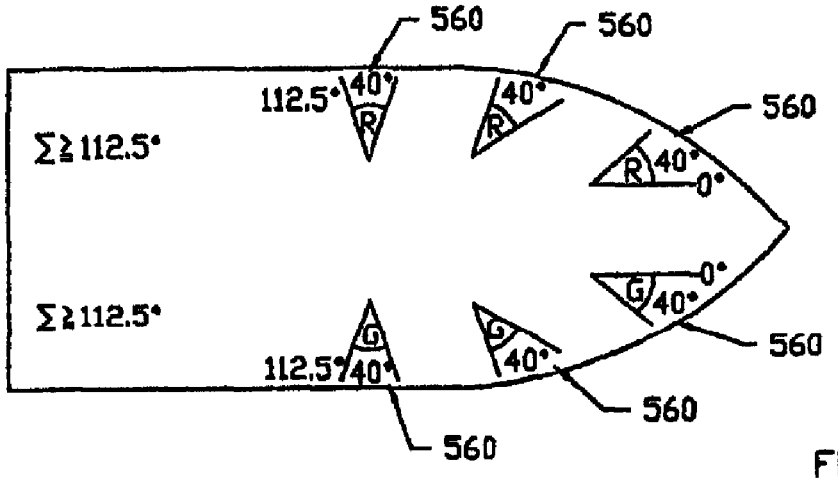

FIG. 24 is similar to FIG. 19 except FIG. 24 uses partial arc colored lights 560 and stops at a back angle of 112.5 degrees on each side of the subject boat.

Figure 25:
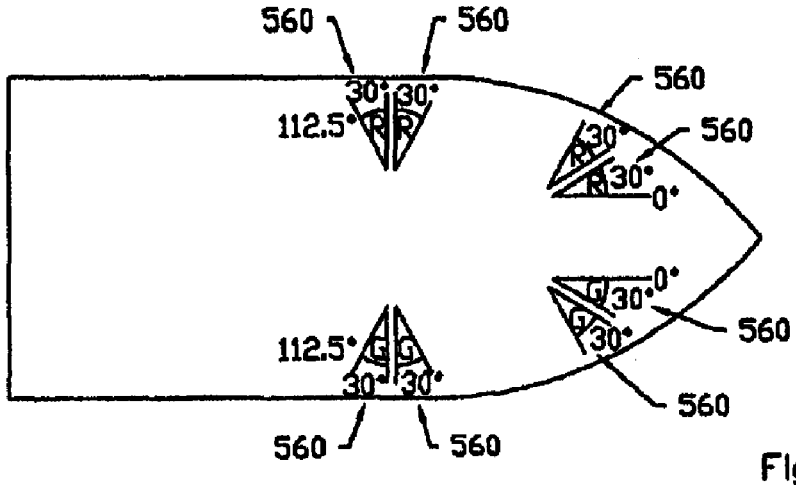

FIG. 25 is similar to FIG. 20 except FIG. 25 uses partial arc colored lights 560 and stops at a back angle of 112.5 degrees on each side of the subject boat. The narrow angle of 30 degrees is typical of current production LED's.

Figure 26:
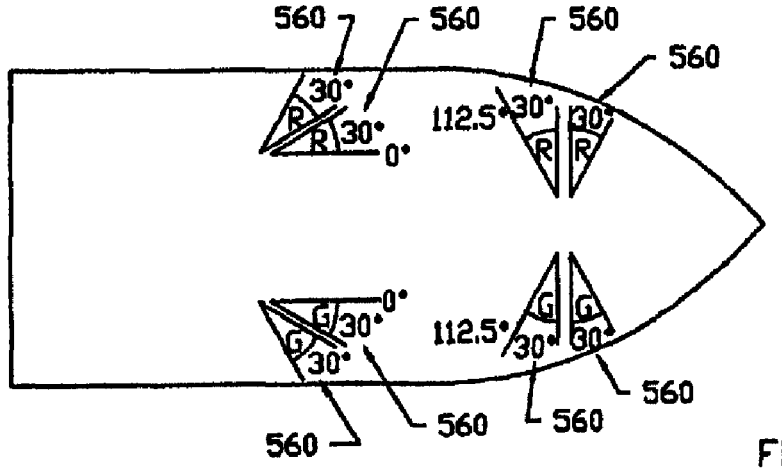

FIG. 26 is similar to FIG. 25 except the light groupings are swapped from front to back in a fashion similar to the swap of lights as shown from FIG. 15 to FIG. 18 to show an optically equivalent display to a distant observer.

Figure 27:
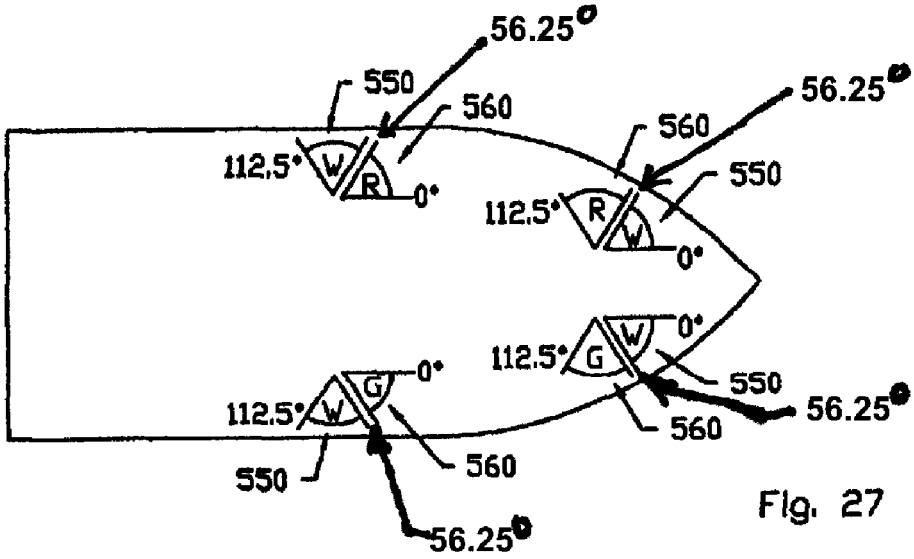

FIG. 27 shows a novel arrangement of how a spatially separated, partial arc, piecewise continuous white light 550 can be combined with a similar spatially separated, partially arc, piecewise continuous colored light 560 (e.g., red or green) to form a system of lights to minimize glare and maximize conspicuity. A distant observer located dead ahead (at zero degrees, or directly in front of the boat) will see a pair of white lights on either side of the centerline of the boat and a red light on the port side and a green light on the starboard side of the subject boat. As the observer passes the port side of the subject boat, he will see the white light and the red light magically change positions as the observer passes the midpoint of the light pairs located at a back angle of 56.25 degrees. This may be any convenient angle, for example 60 degrees back angle from dead ahead. As the observer continues along the port side of the subject boat he will continue to see a red light and a white light until he reaches a back angle of 112.5 degrees at which point the red light will disappear. A white light (not shown) will continue to be visible all the way to a back angle of 180 degrees. Similarly, as the observer passes the starboard side of the subject boat, he will see the white light and the green light magically change positions as the observer passes the midpoint of the light pairs located at a back angle of 56.25 degrees. This may be any convenient angle, for example 60 degrees back angle from dead ahead. As the observer continues along the starboard side of the subject boat he will continue to see a green light and a white light until he reaches a back angle of 112.5 degrees at which point the green light will disappear. A white light (not shown) will continue to be visible all the way to a back angle of 180 degrees. The lights of FIG. 27 have mutually exclusive horizontal sectors, which again means that there is no substantial overlap of emitted light between the two lights of the same color. However, one colored light is always visible as is one white light at any angle forward of 112.5 degrees back angle. It is just that the two lights always are separated from each other as viewed by a distant observer.

Figure 28:
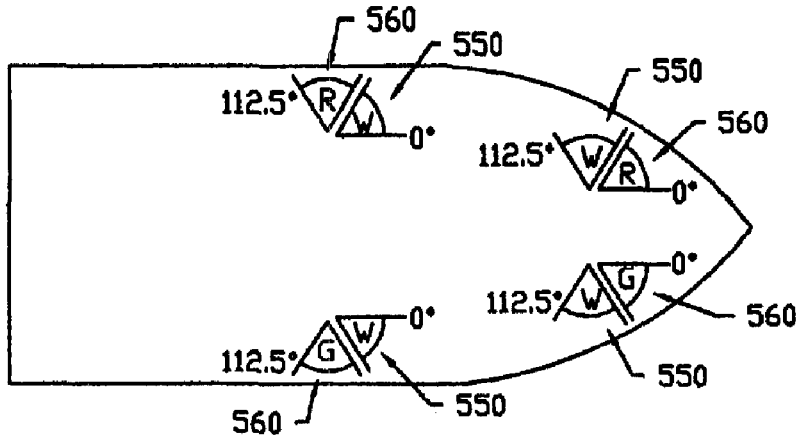

FIG. 28 is similar to FIG. 27 except the red and white lights are swapped and the green and white lights are swapped. This arrangement is optically similar to FIG. 27 except it has the disadvantage of allowing excessive white light from the rear red and white lights to spill onto the boat thus causing excessive glare to the operator of the boat. The same is true for the starboard side of the subject boat.

Figure 29:
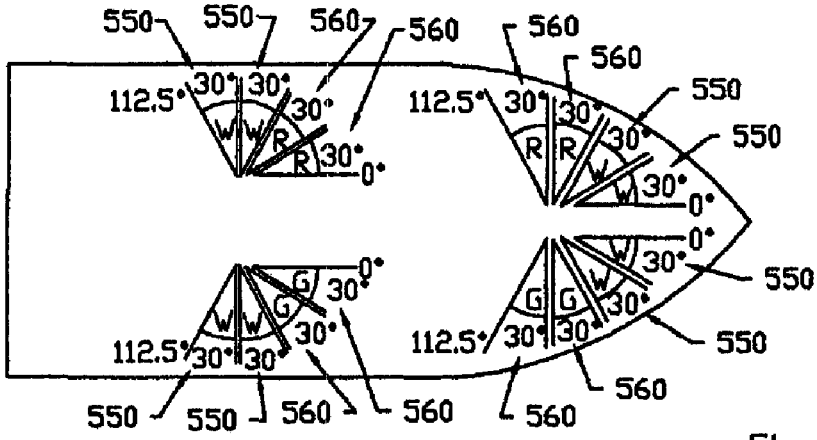

FIG. 29 is similar to FIG. 27 except it uses narrow angle lamps including LED's of FIG. 20 and FIG. 26 that have a fairly narrow angle of emission of approximately 30 degrees. FIG. 29 is simply the combination of FIG. 20 and FIG. 26. This embodiment lends itself to a compact and robust installation. The rearward cluster of four LED's on each side has to be mounted sufficiently to the side of the centerline of the boat to ensure proper visual separation when viewed head on by a distant observer.

Figure 30:
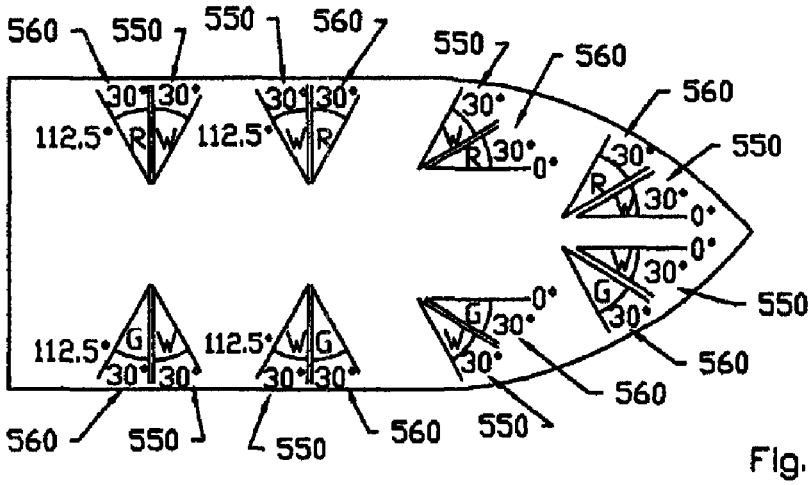

FIG. 30 is similar to FIG. 28 except the lights are broken into colored and white pairs of lights to be suitably placed along the perimeter of the boat. This embodiment is particularly suited to LED's placed along and imbedded in the side of the boat at or near the shear line or rub rail along the outer edge of the boat. As a distant observer passes the port side of the subject boat, he will always see a red light and a white light spatially separated from each other. The red light will disappear at a back angle of 112.5 degrees. Similarly, as a distant observer passes the starboard side of the subject boat, he will always see a green light and a white light spatially separated from each other. The green light will disappear at a back angle of 112.5 degrees.

Figure 31T:
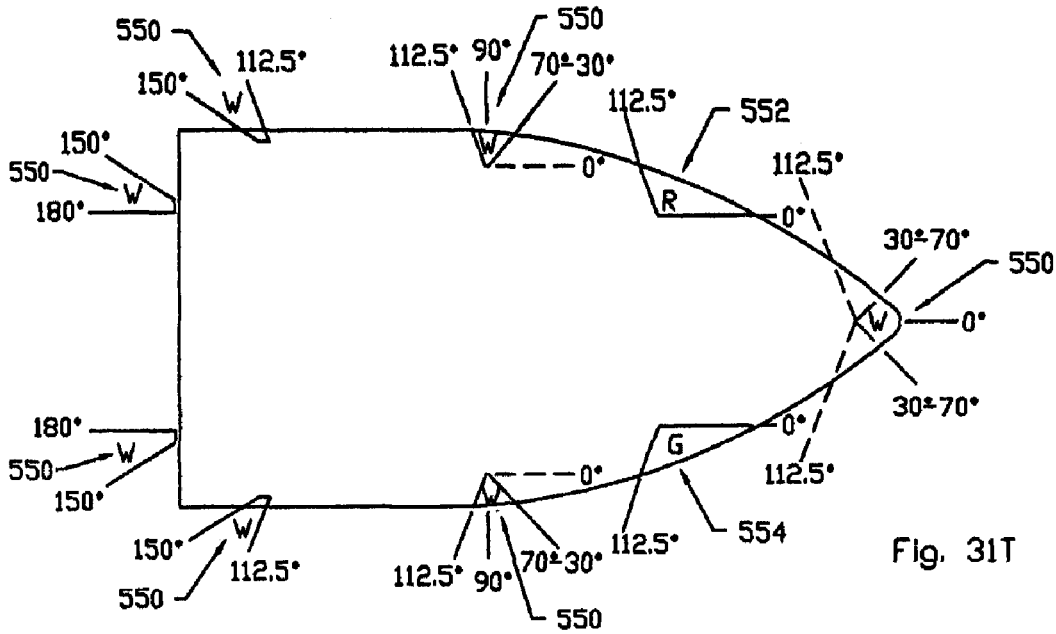
FIG. 31T, FIG. 31S, and FIG. 31F, are the Top, Side, and Front views respectively, of a typical V-hull boat with a navigation light system according to an embodiment of the present invention.
Figure 31S:
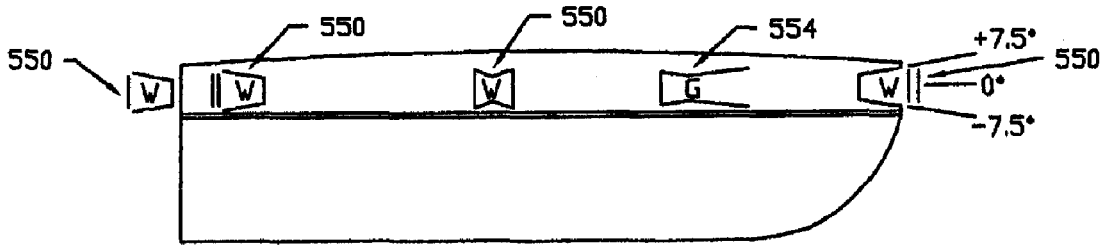
Figure 31F:
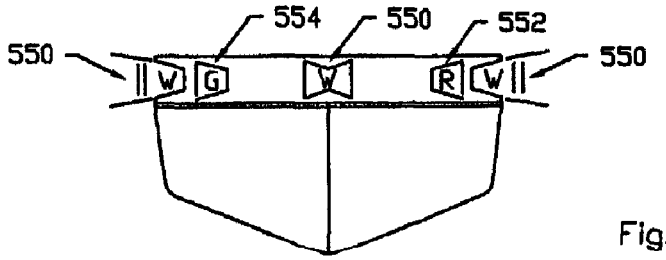

FIG. 31T is a top view of a boat with partial arc white lights at the front and the sides similar to those shown in FIG. 17 and partial arc white lights at the stern at the rear end of the boat similar to those shown in FIG. 19. Note that the back cutoff angle of the partial arc white lights is indeterminate. For example, the bow mounted partial arc white light shows a back angle of any where from a minimum of 30 degrees to a maximum of 70 degrees. But then it is necessary for another partial arc white light located on the side of the boat have a complementary cutoff angle. Specifically, the side mounted light in this example must have a front cutoff angle of 70 degrees to 30 degrees. These cutoff angles are arbitrary and there can be areas of overlap, but it is necessary that there are no blank areas of illumination. Ironically, the regulatory authorities do permit an occlusion of 7.5 degrees in acknowledgment of physical hardware that is sometimes placed towards the outboard side of the prior art lights. Note that the stern mounted partial arc white lights comprised of four lights also have intermediate cutoff angles. In this example, the cutoff angle is 150 degrees, however, this angle is arbitrary and can be greater or less than the angle as shown. In this example, each of the four stern mounted lights has a subtended angle of approximately 30 degrees that makes the use of current LED's attractive. FIG. 31S is a side view of the boat of FIG. 31T, and shows the partial arc lights mounted to the boat near or above the shear line. FIG. 31F is a front view of the boat of FIG. 31T, and shows the partial arc lights mounted to the boat.

Figure 32T:
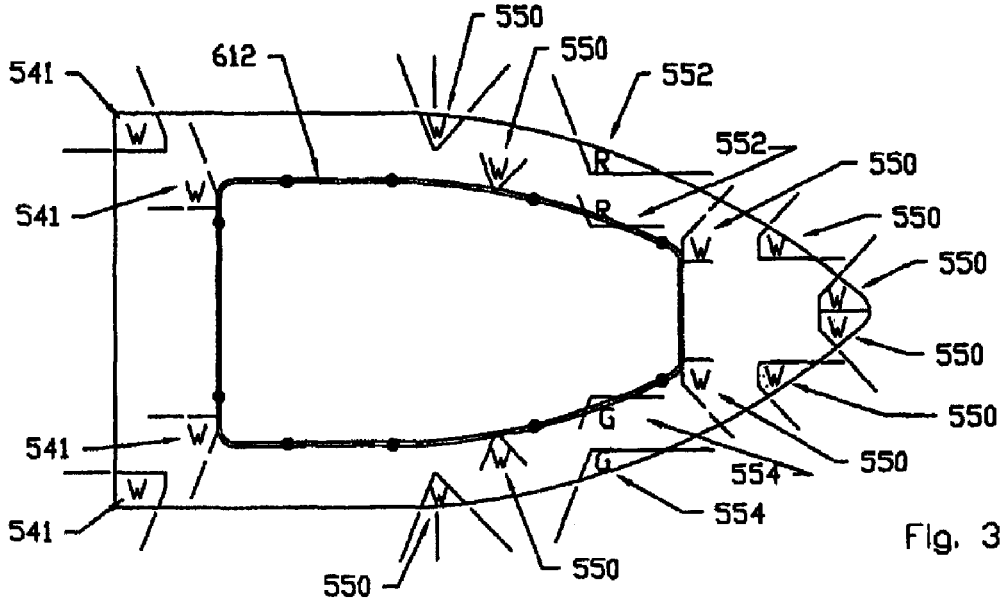
FIG. 32T, FIG. 32S, and FIG. 32F, are the Top, Side, and Front views respectively, of a typical V-hull boat with a navigation light system according to an embodiment of the present invention.
Figure 32S:
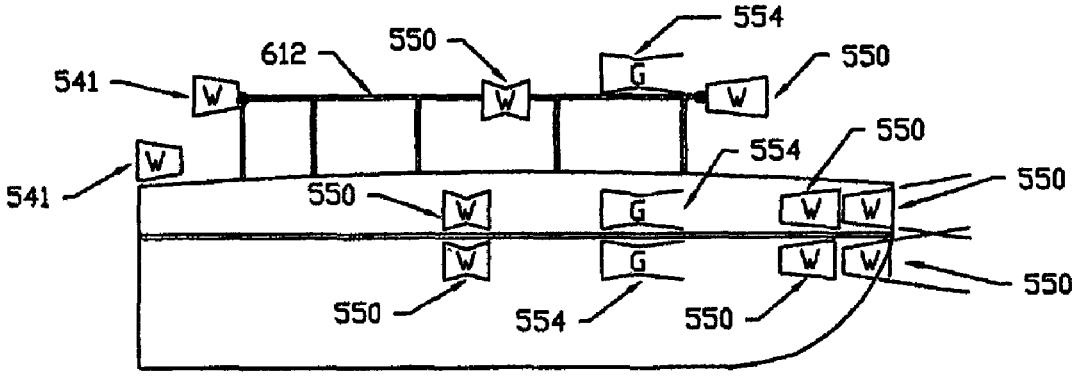

FIG. 32T is a top view of a boat similar to FIG. 31, yet has a raised railing 612 to which the various lights can be affixed to increase vertical separation of the lights. Not all of the lights are necessary to be installed or displayed, but are shown at the various optional locations that can be used to ensure that the lighting system is a spatially separated, piecewise continuous, partial arc white light system. The Figure illustrates a full arc red 552 light and a full arc green 554 light. FIG. 32S is a side view of the boat of FIG. 32T, and shows the partial arc lights mounted to the raised railing. The side view emphasizes the ability to mount the colored lights at one elevation and the white lights at a different elevation to increase the visual separation distance of one color relative to the other color. Current regulations require that the white lights be located at an elevation higher than the colored lights. This regulation may be revised to allow the lights to be mounted in a more suitable location to meet the safety needs of newer boats.

Figure 32F:
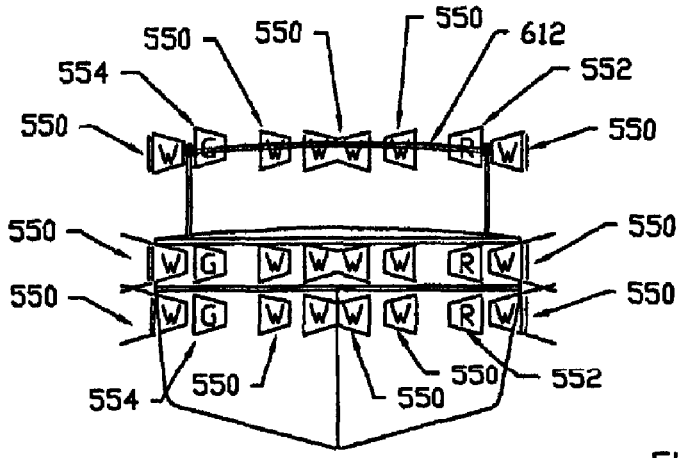

FIG. 32F is a front view of the boat of FIG. 32T, and shows the partial arc lights mounted to the raised railing. Again, not all of these lights are required, however, there is no prohibition to mounting all of the lights so long as the lights do not cause visual confusion of distinguishing one color from another and the intent of the navigation lights. Under these circumstances of excessive lights, they can simply be considered accessory lights that would be allowed within the law.

Figure 33T:
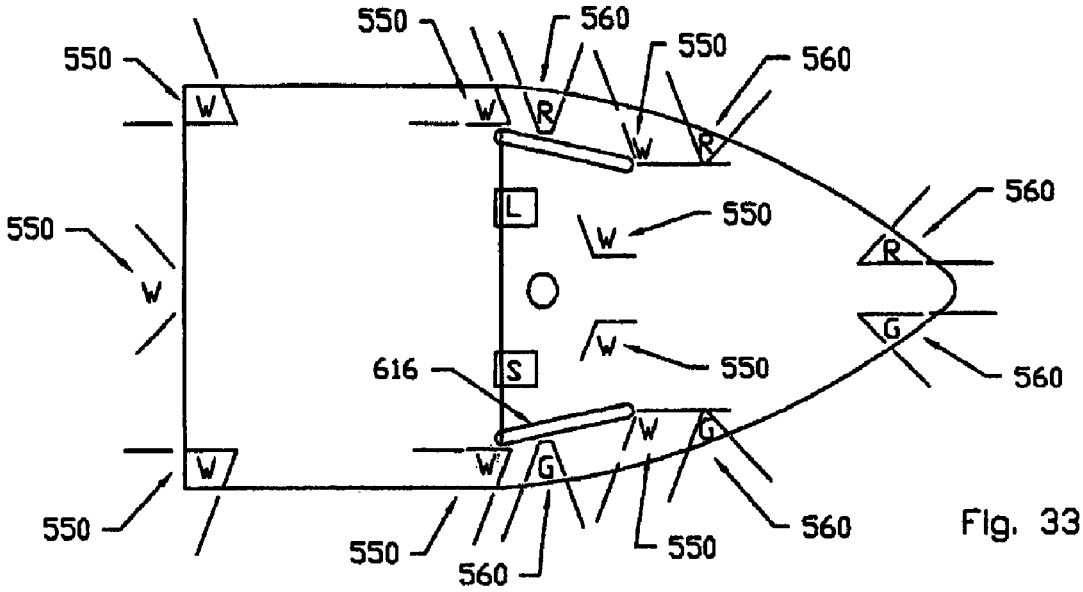
FIG. 33T, FIG. 33S, and FIG. 33F, are the Top, Side, and Front views respectively, of a typical V-hull boat with a navigation light system according to an embodiment of the present invention.
Figure 33S:
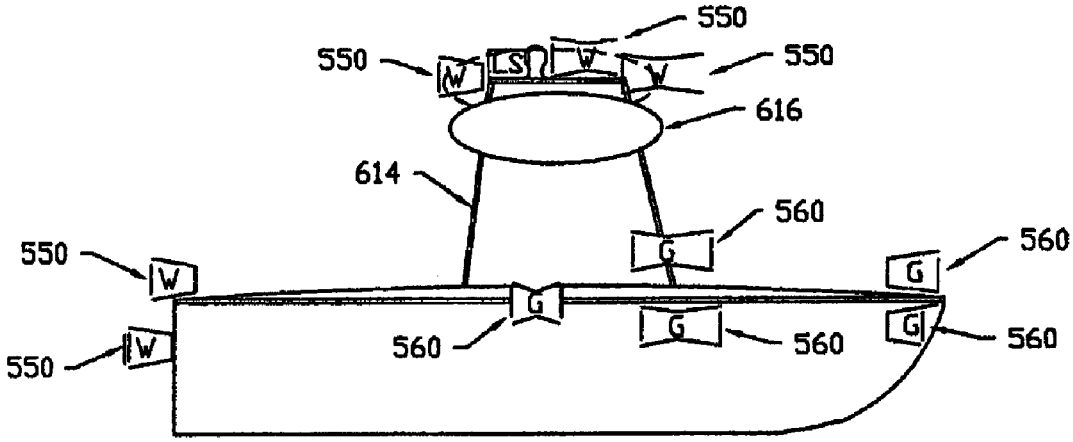
Figure 33F:
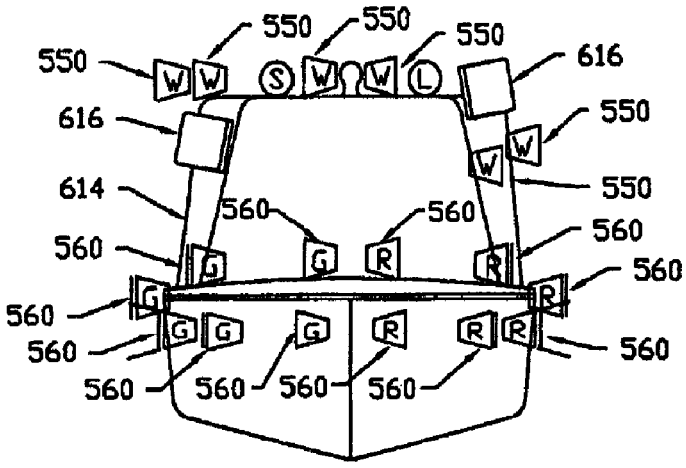

FIG. 33T is a top view of a boat similar to FIG. 32T except there is a water ski tower 614 mounted to the boat rather that the prior railing. This is a uniquely troublesome installation because after market towers usually occlude the standard rear mounted all around 525, navigation light as shown in FIG. 3. Often, these water ski towers are fitted with a prior art single light mounted at the center of the top of the tower. This installation shows the partial arc white lights 550 of FIG. 15 and the partial arc colored lights 560 of FIG. 22 combined on the boat. FIG. 33S is a side view of FIG. 33T and shows the height of the water ski tower 614 with the partial arc white lights mounted thereon. The boat occupants often mount accessories and racks to hold water skis or wakeboards 616 on the upper portion of the tower and thus occlude the light from emanating out to a distant observer. FIG. 33F is a front view of FIG. 33T and shows how the partial arc white lights 550 can be mounted above or below the wakeboards such that the light is not occluded from the view of a distant observer. Also, the advantage of mounting the partial arc lights on the edge of the tower is that there is a reduction of glare due to fugitive light striking the tower parts or the wakeboards.

Figure 34T:
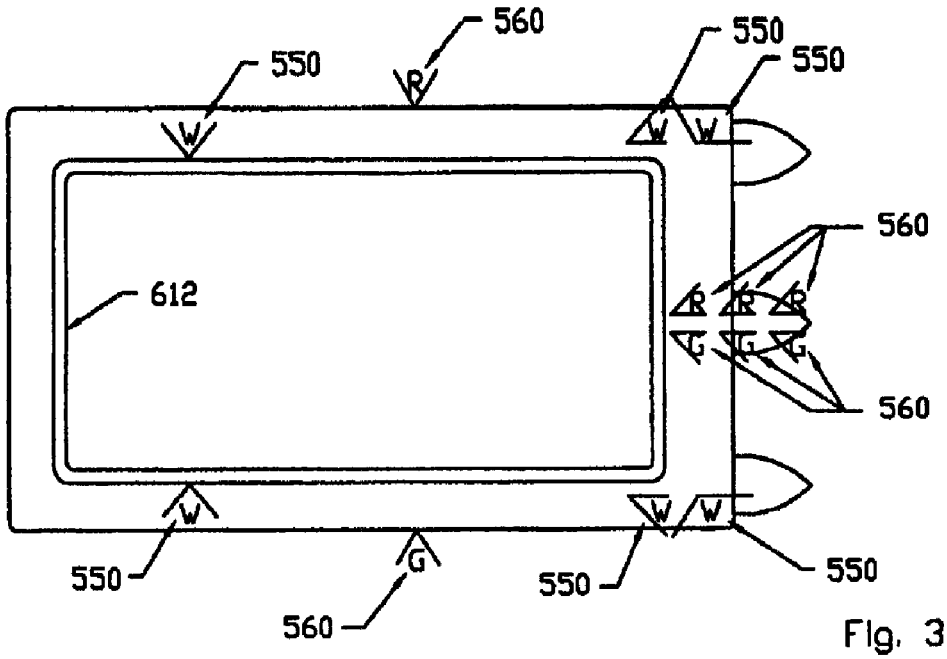
FIG. 34T, FIG. 34S, and FIG. 34F, are the Top, Side, and Front views respectively, of a typical pontoon boat with a navigation light system according to an embodiment of the present invention.
Figure 34S:
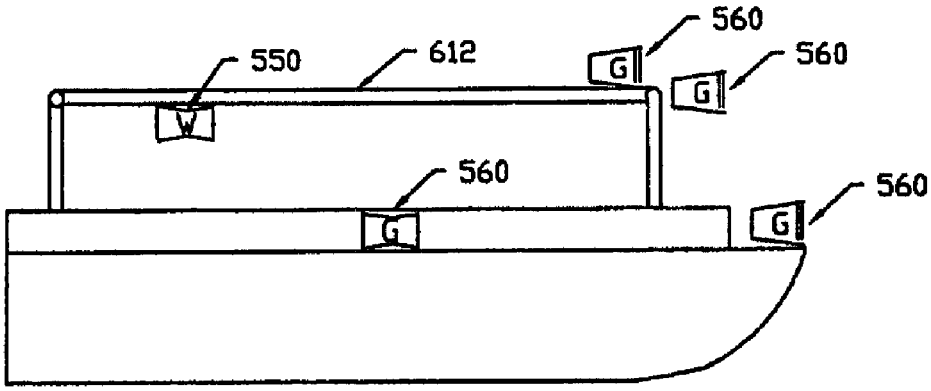
Figure 34F:
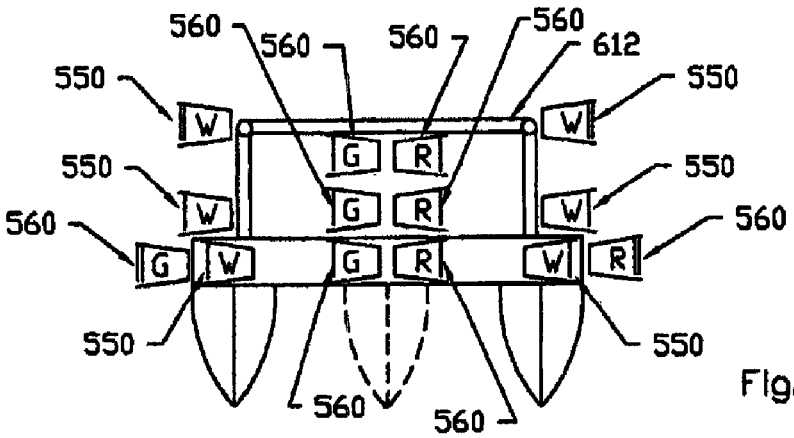

FIG. 34T is a top view of a pontoon boat with a raised railing 612 around the perimeter of the boat. This is a fairly common hardware configuration. Partial arc white lights 550 of FIG. 22 and partial arc colored lights 560 of FIG. 15 are used on this boat. As in the above Figures not all of the lights are required, however they are not prohibited unless they conflict with the Navigation Rules. Note how the use of partial arc lights eliminates the problem of light striking the surface of the boat and causing glare to an operator. Note also how the use of partial arc lights also eliminates the problem of occlusion of the outward directed light due to objects or people in the boat. FIG. 34S is a side view of FIG. 34T and shows some of the lights emphasizing the visual separation of the partial arc colored lights. FIG. 34F is a front view of FIG. 34T and shows redundant lights in various locations that can be selected to ensure visual separation of the colored lights from the white lights.

Figure 35T:
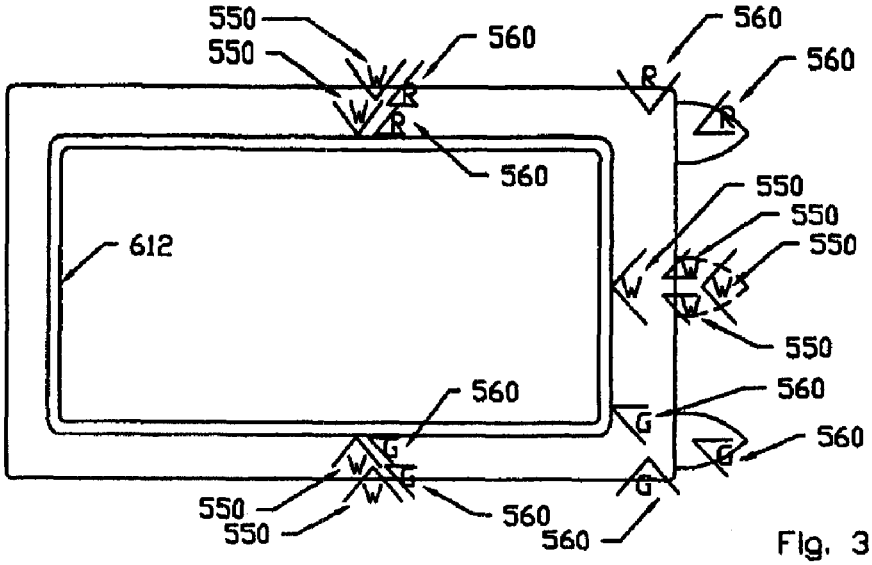
FIG. 35T, FIG. 35S, and FIG. 35F, are the Top, Side, and Front views respectively, of a typical pontoon boat with a navigation light system according to an embodiment of the present invention.
Figure 35S:
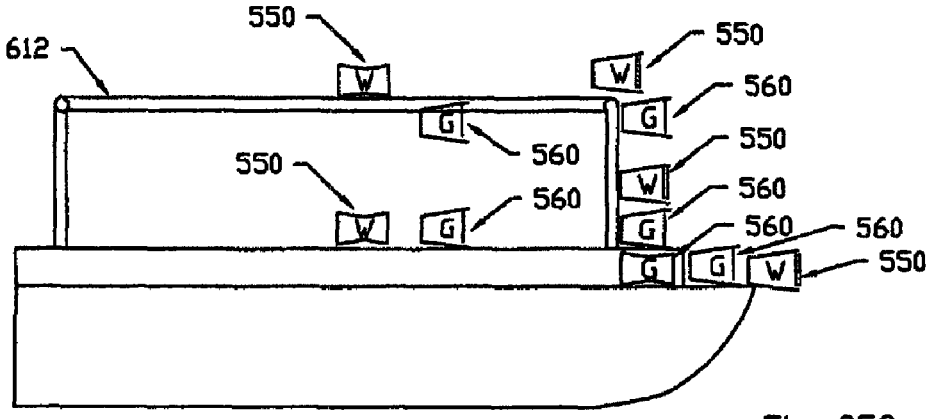

FIG. 35T is a top view of a pontoon boat similar to FIG. 34. The difference is that the partial arc white light 550 mounted at the center of the front of the boat now replaces the colored light of FIG. 34. The other partial arc white lights 550 and partial arc colored lights 560 are also swapped with regard to location and angles of emission. FIG. 35 compares to FIG. 27 as FIG. 34 compares to FIG. 28. FIG. 35S is a side view of FIG. 35T and shows the vertical separation similar to FIG. 34S.

Figure 35F:
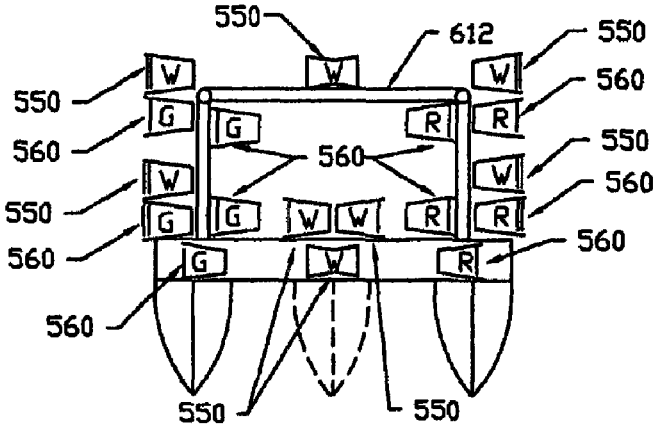

FIG. 35F is a front view of FIG. 35T and shows redundant lights in various locations that can be selected to ensure visual separation of the colored lights from the white lights.

Figure 36T:
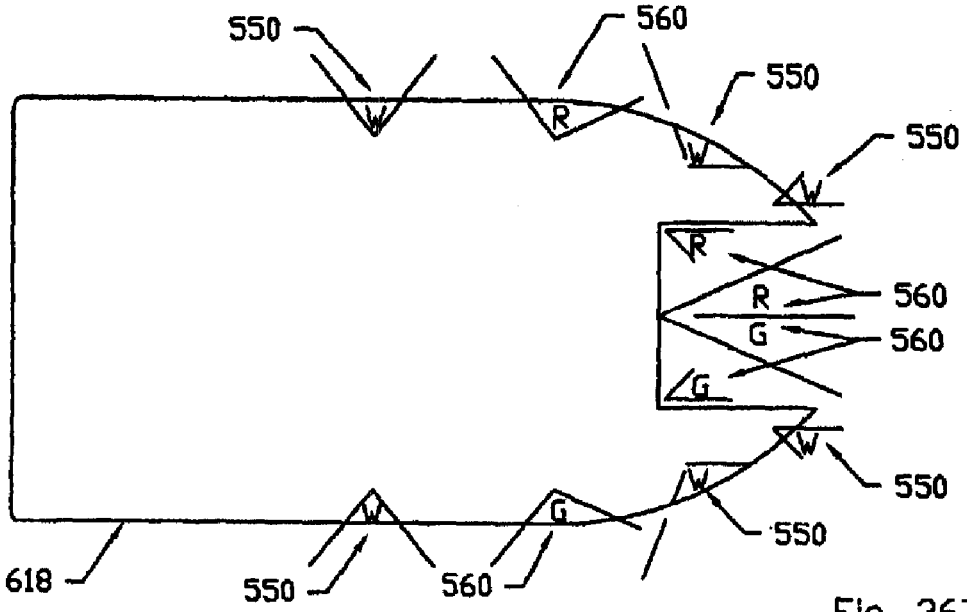
FIG. 36T, FIG. 36S, and FIG. 36F, are the Top, Side, and Front views respectively, of a typical catamaran boat with a navigation light system according to an embodiment of the present invention.
Figure 36S:
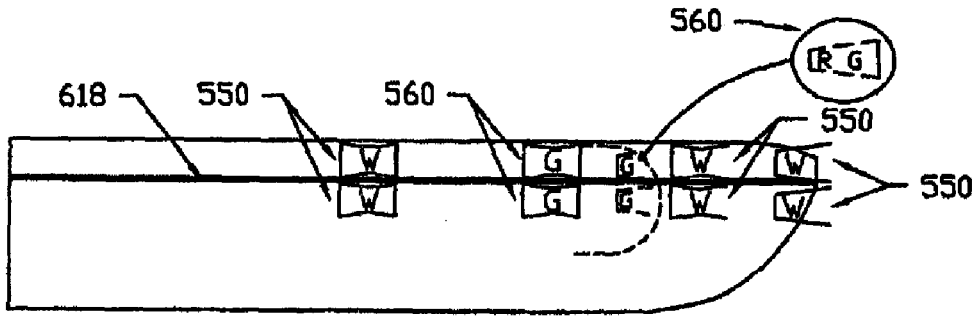
Figure 36F:
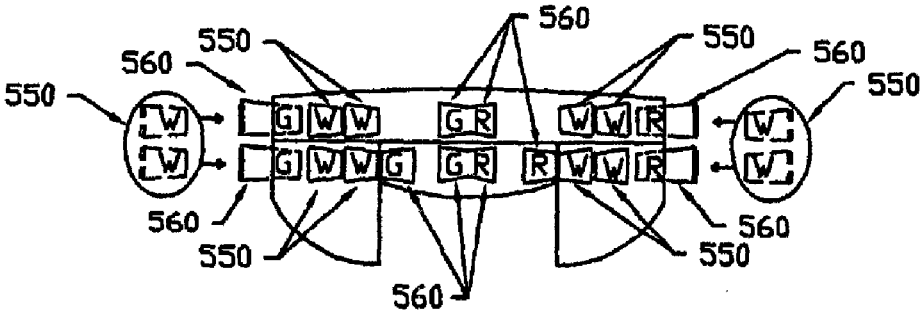

FIG. 36T is a top view of catamaran. This style of boat is particularly well suited for partial arc lights because the location of a single front mounted masthead light as shown in FIG. 1 cannot be mounted anywhere without causing glare and cannot even be mounted at the front center of the hull at a low position without the desired light being occluded by the hull itself. This figure shows the partial arc white lights 550 of FIG. 15 and the partial arc colored lights 560 of FIG. 22. Note the partial arc colored lights 560 are mounted in the recess in the center of the front of the hull and have a partial arc of emission to eliminate light from striking the hull. The partial arc colored lights 560 mounted on the very front of the boat are complemented by the spatially separated, partial arc colored lights 560 mounted to the side of the boat to form a piecewise continuous display of lights to a distant observer. The partial arc white lights 550 mounted on the very front of the boat are complemented by the spatially separated, partial arc white lights 550 mounted to the side of the boat to form a piecewise continuous display of lights to a distant observer. FIG. 36S is a side view of FIG. 36T and shows how the lights can be mounted around the perimeter of the boat to be conveniently located above or below, or even along, the shear line 618. Note that vertical separation is not necessary to ensure visual separation. Not all of the lights are required to be installed and may be undesirable. FIG. 36F is a front view of FIG. 36T and shows many possible locations for a navigation light system according to an embodiment of the present invention.

Figure 37T:
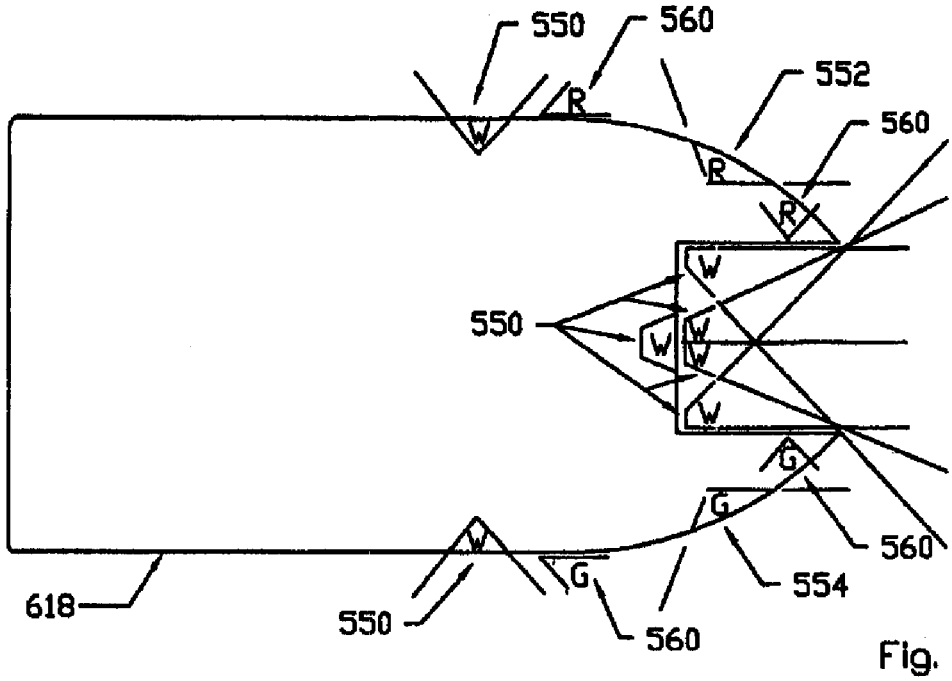
FIG. 37T, FIG. 37S, and FIG. 37F, are the Top, Side, and Front views respectively, of a typical catamaran boat with a navigation light system according to an embodiment of the present invention.
Figure 37S:
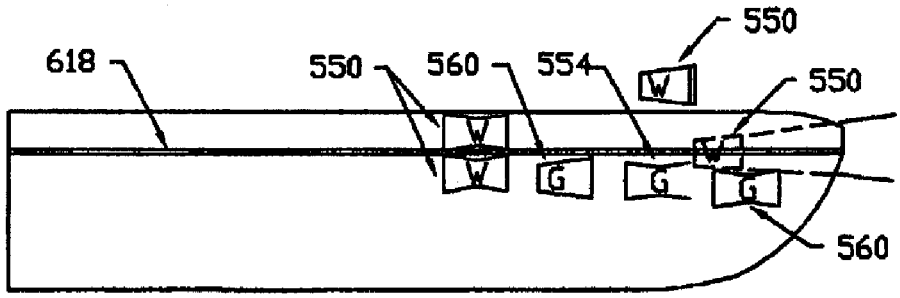
Figure 37F:
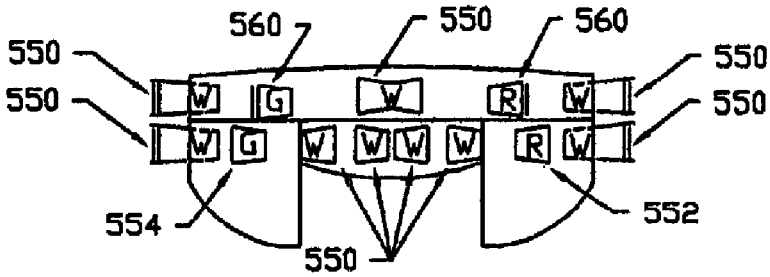

FIG. 37T is a top view of a boat similar to FIG. 36 except the partial arc white lights 550 are swapped in location with the partial arc colored lights 560. The partial arc white lights of FIG. 37 are similar to the location of the white lights of FIG. 15. The partial arc colored lights of FIG. 37 are similar to the location of the colored lights shown in FIG. 23. When the white lights are combined with the colored lights, the boat is visually equal to FIG. 27. FIG. 37S is a side view of FIG. 37T and shows how the lights can be mounted around the perimeter of the boat to be conveniently located above or below, or even along, the shear line 618. Note that vertical separation is not necessary to ensure visual separation. Not all of the lights are required to be installed and may be undesirable. FIG. 37F is a front view of FIG. 37T and shows many possible locations for the lights of a navigation light system according to an embodiment of the present invention.

Figure 38T:
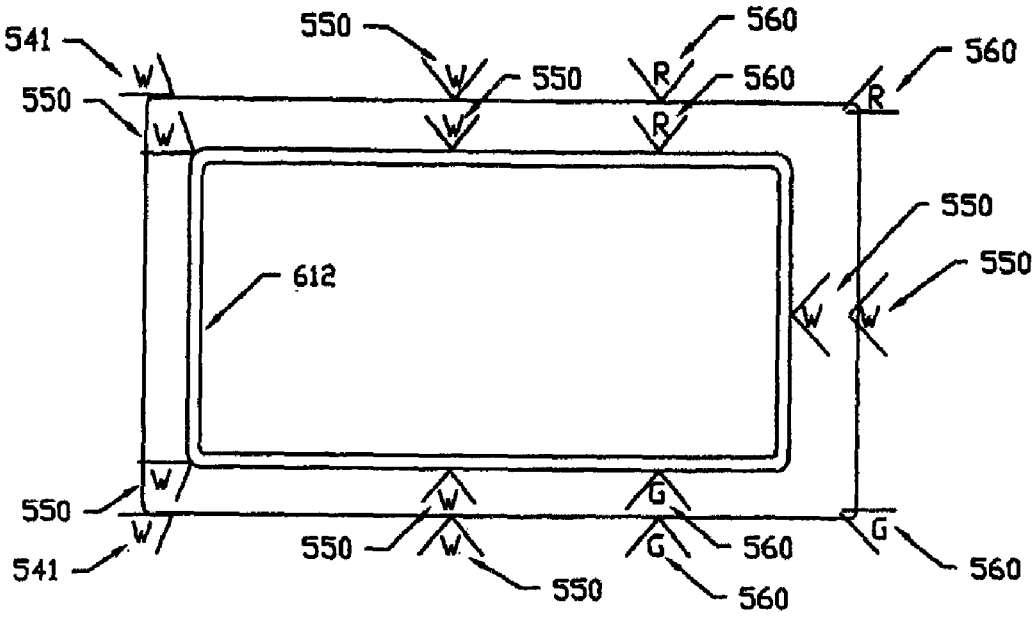
FIG. 38T, FIG. 38S, and FIG. 38F, are the Top, Side, and Front views respectively, of a typical jon boat with a navigation light system according to an embodiment of the present invention.
Figure 38S:
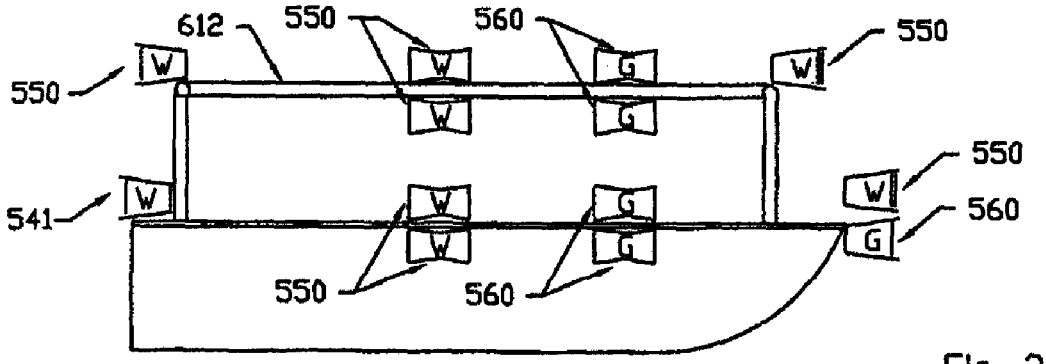
Figure 38F:
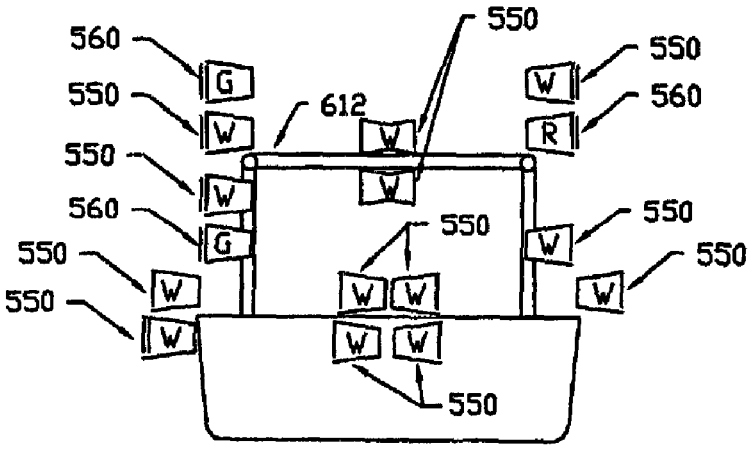

FIG. 38T is a top view of a jon boat similar to the pontoon boat of FIG. 35. The partial arc white lights 550 and partial arc colored lights 560 are in similar locations to FIG. 35. FIG. 38S is a side view of FIG. 38T and shows the vertical separation of the partial arc lights. Lights can be mounted on raised railing 612 or on the boat hull to ensure enhanced visual separation of the partial arc white lights 550 and partial arc colored lights 560. FIG. 38F is a front view of FIG. 38T and shows redundant lights in various locations that can be selected to ensure visual separation of the colored lights from the white lights.

Figure 39T:
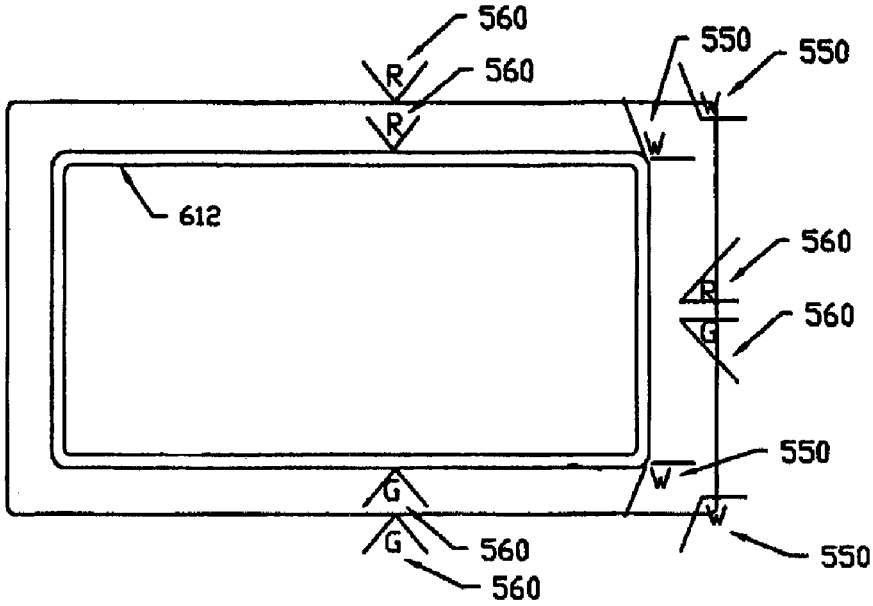
FIG. 39T, FIG. 39S, and FIG. 39F, are the Top, Side, and Front views respectively, of a typical jon boat with a navigation light system according to an embodiment of the present invention.
Figure 39S:
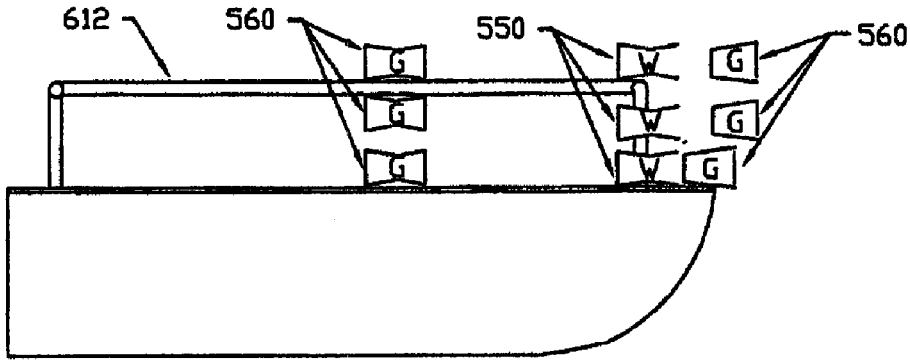
Figure 39F:
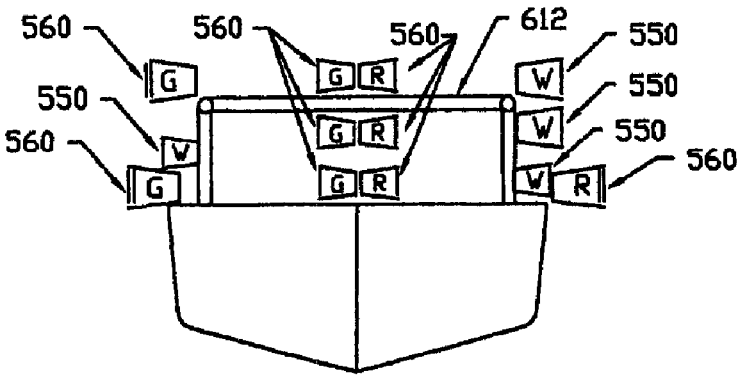

FIG. 39T is a top view of a boat similar to FIG. 38 except the partial arc white lights 550 are swapped with the partial arc colored lights 560. FIG. 39 compares with FIG. 38 as FIG. 36 compares to FIG. 37. FIG. 39S is a side view of FIG. 39T and shows the vertical separation of the partial arc lights. Lights can be mounted on raised railing 612 or on the boat hull to ensure enhanced visual separation of the partial arc white lights 550 and partial arc colored lights 560. FIG. 39F is a front view of FIG. 39T and shows redundant lights in various locations that can be selected to ensure visual separation of the colored lights from the white lights.

Figure 40T:
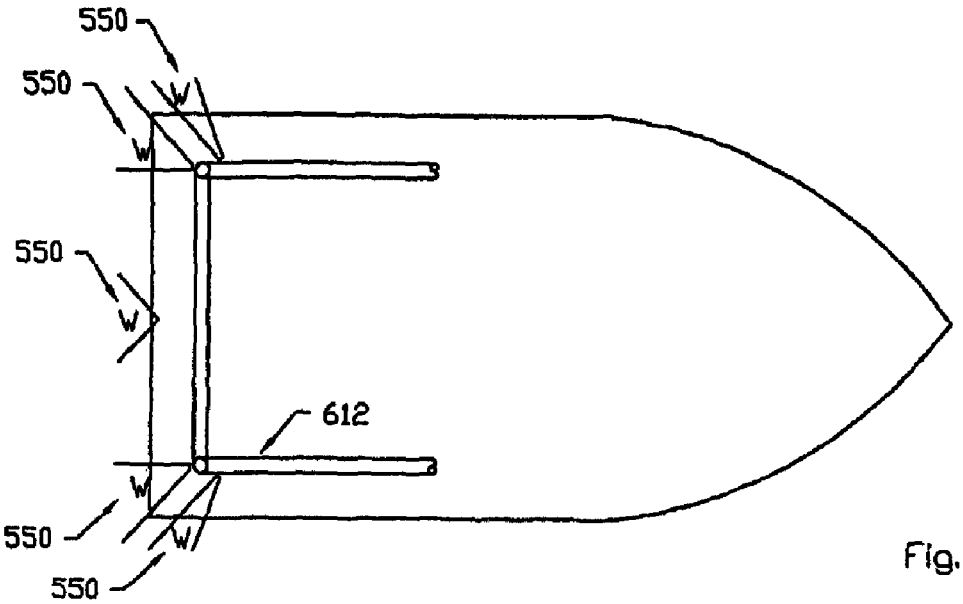
FIG. 40T, FIG. 40S, and FIG. 40R, are the Top, Side, and Rear views respectively, of a typical V-hull boat with a navigation light system according to an embodiment of the present invention.
Figure 40S:
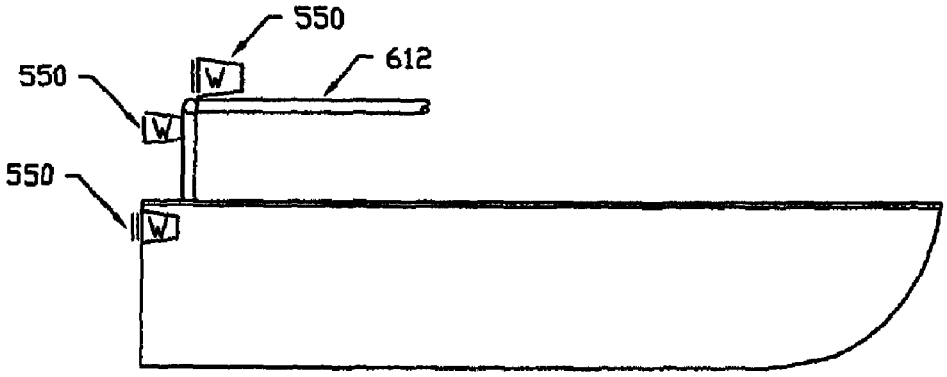
Figure 40R:
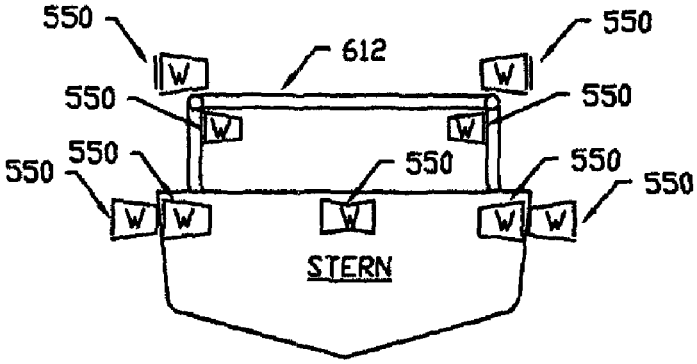

FIG. 40T is a top view of a boat showing a raised railing 612 with partial arc white lights 550 mounted to serve as stern lights similar to FIG. 19. FIG. 40S is a side view of FIG. 40T and shows how the lights can be attached to the raised railing or to the boat hull. FIG. 40R is a rear view of FIG. 40T and shows how the lights can be attached to the raised railing or to the boat hull. Not all lights are desirable or necessary. However, there is not a problem with visual confusion between the white and colored lights as only white lights are displayed at the rear of the boat.

Figure 41T:
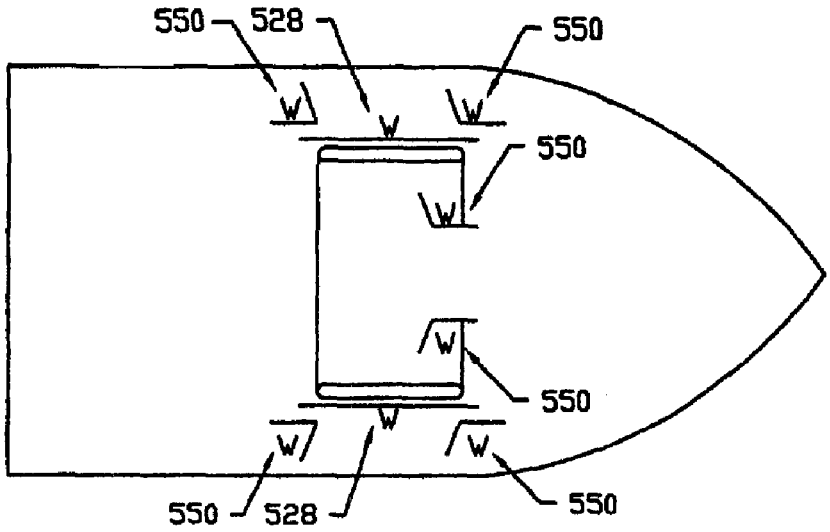
FIG. 41T, FIG. 41S, and FIG. 41F, are the Top, Side, and Front views respectively, of a typical V-hull boat with a navigation light system according to an embodiment of the present invention.
Figure 41S:
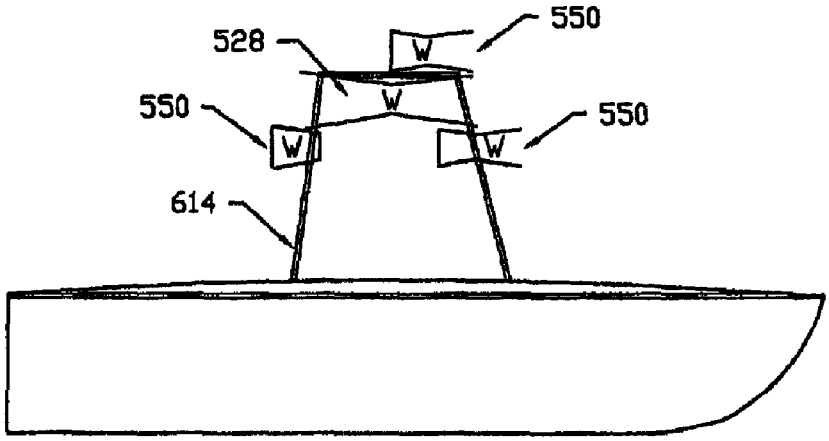
Figure 41F:
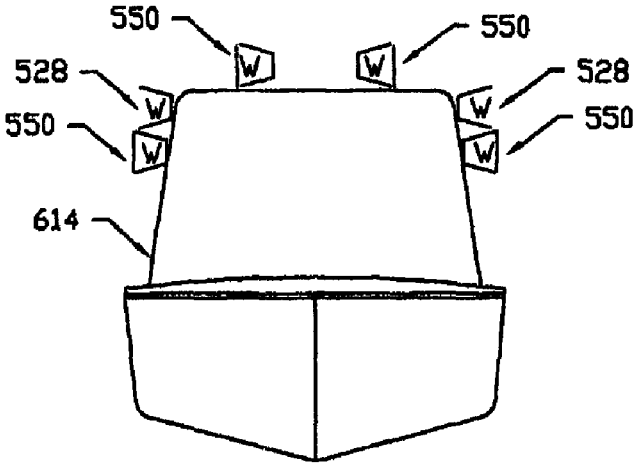

FIG. 41T is a top view of a boat similar to FIG. 33 including a water ski tower 614 with parallel edges. This water ski tower is fitted with half all around lights 528 as shown in FIG. 5. Alternatively, the boat is also fitted with partial arc white lights 550. The water ski tower can also be construed as a T-top, bimini top, or any raised structure over the heads of the operators. FIG. 41S is a side view of FIG. 41T and shows where the lights can be attached to the water ski tower. FIG. 41F is a front view of FIG. 41T and shows where the lights can be attached to the water ski tower.

Figure 42T:
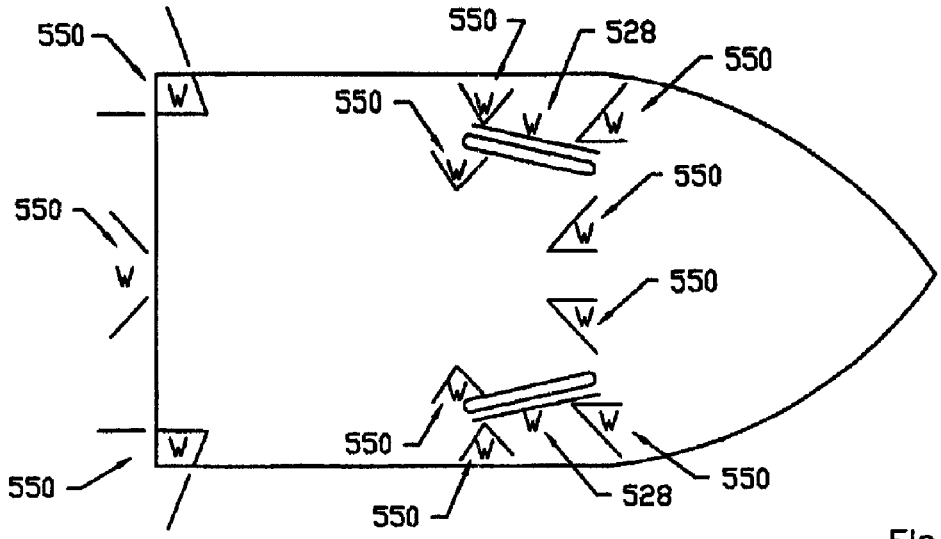
FIG. 42T, FIG. 42S, and FIG. 42F, are the Top, Side, and Front views respectively, of a typical V-hull boat with a navigation light system according to an embodiment of the present invention.
Figure 42S:
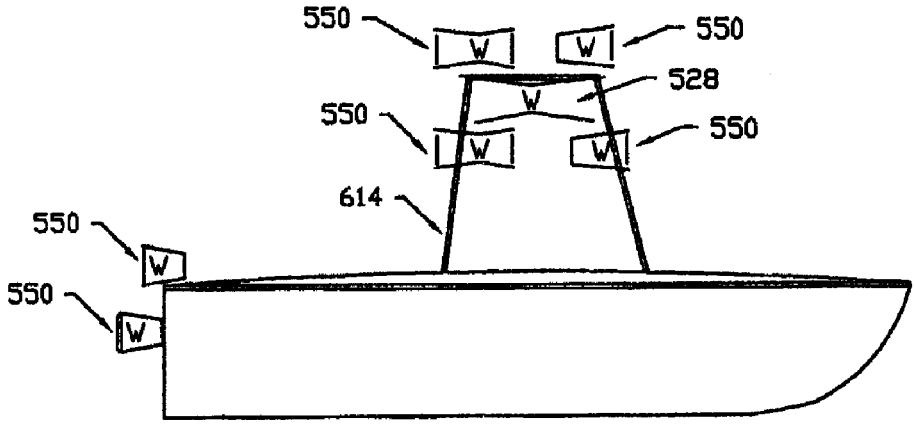
Figure 42F:
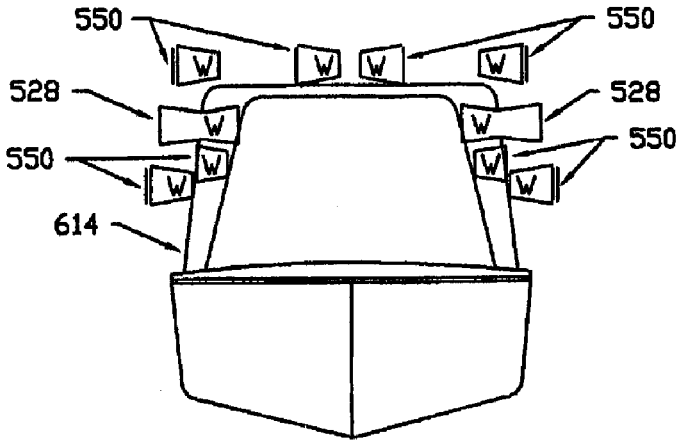

FIG. 42T is a top view of a boat similar to FIG. 41 including a water ski tower 614 that has the edges tapered inward to be harmonious with the lines of the boat contours. This water ski tower is fitted with half all around lights 528 as shown in FIG. 5. Alternatively, the boat is also fitted with partial arc white lights 550. The water ski tower can also be construed as a T-top, bimini top, or any raised structure over the heads of the operators. FIG. 42S is a side view of FIG. 42T and shows where the lights can be attached to the water ski tower. FIG. 42F is a front view of FIG. 42T and shows where the lights can be attached to the water ski tower.

Figure 43T:
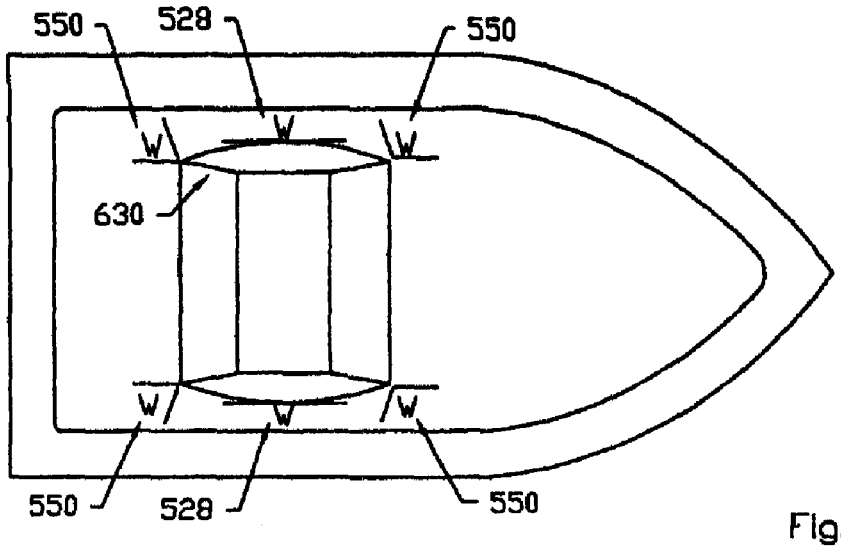
FIG. 43T, FIG. 43S, and FIG. 43F, are the Top, Side, and Front views respectively, of a typical V-hull boat with a navigation light system according to an embodiment of the present invention.
Figure 43S:
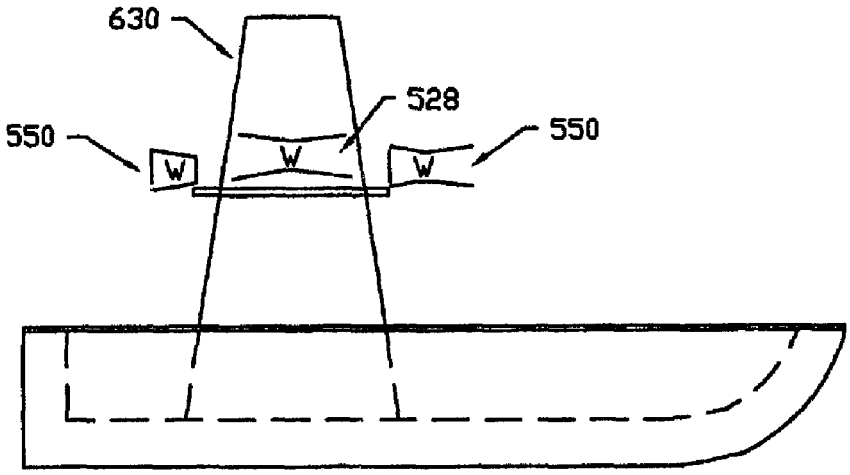
Figure 43F:
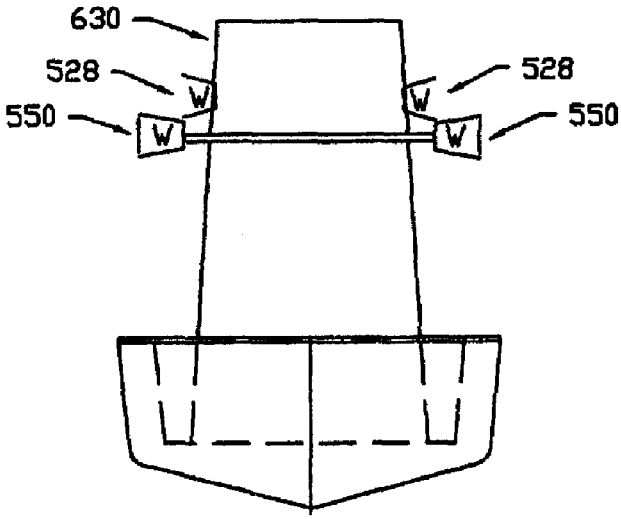

FIG. 43T is a top view of a boat similar to FIG. 41 including a raised structure known as a tuna tower 630 with parallel edges. This tuna tower is fitted with half all around lights 528 as shown in FIG. 5. Alternatively, the boat is also fitted with partial arc white lights 550. Tuna towers usually have a strong roof and higher railing to allow a person to stand on the raised platform above the operator's head. The higher railing usually causes obstructions that cause serious occlusion problems if the boat is fitted with only one masthead light or only one all around light. FIG. 43S is a side view of FIG. 43T and shows where the lights can be attached to the tuna tower. FIG. 43F is a front view of FIG. 43T and shows where the lights can be attached to the tuna tower.

Figure 44T:
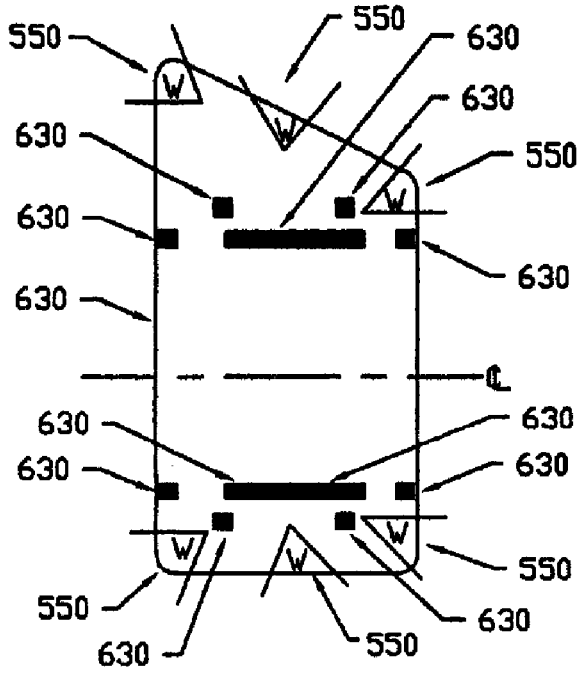
FIG. 44T, FIG. 44S, and FIG. 44F, are the Top, Side, and Front views respectively, of a typical tuna tower with a navigation light system according to an embodiment of the present invention.
Figure 44S:
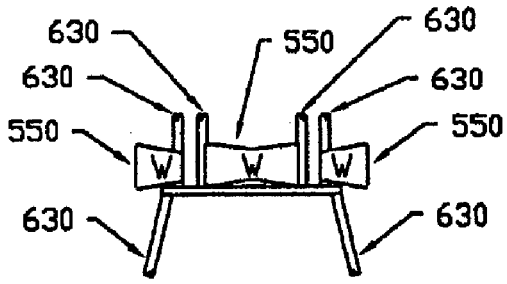
Figure 44F:
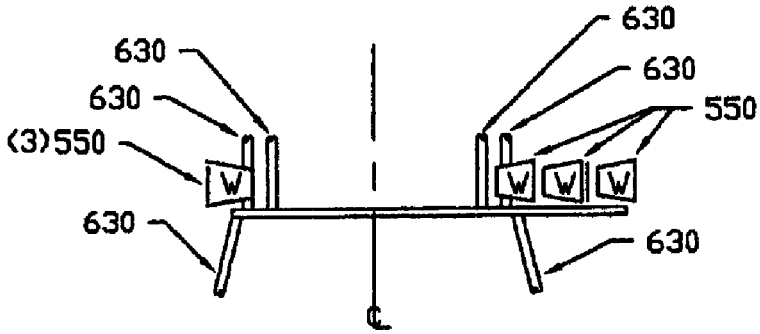

FIG. 44T is a top view of just the raised platform section of a tuna tower 630. This view shows an asymmetric view to depict how partial arc white lights 550 can be fitted to a tower that has either tapered edges as shown in the top half of FIG. 44T or to a tower that has parallel edges as shown in the bottom half of FIG. 44T. Usually, the platform is symmetric with either parallel edges or tapered edges. The heavy black lines represent the posts to support the upper railing or represent other obstructions necessary or convenient for boat operation. It is easy to see why the partial arc lights are placed towards the outside of these obstructions to avoid occlusion. It is also easy to see lights are configured as partial arc lights to prevent light from striking the occlusions and causing glare to an operator. Even though the glare is above the operator's head, it still causes sufficient fugitive light and secondary glare which impairs the operator's ability to maintain proper lookout. FIG. 44S is a side view of FIG. 44T and shows where the lights can be attached to the tuna tower. The lights can be attached at the platform edge or even below the edge. However, if the lights are mounted above the platform, the amount of glare will be minimized because the platform acts as a brow to shield the downcast glare from affecting the operator's vision. FIG. 44F is a front view of FIG. 44T and shows where the lights can be attached to the tuna tower.

Figure 45T:
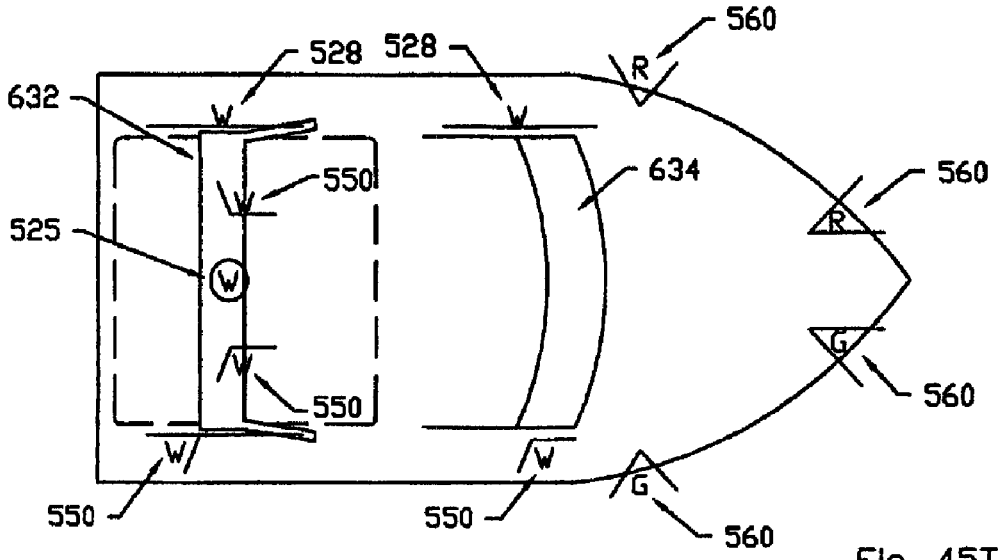
FIG. 45T, FIG. 45S, and FIG. 45F, are the Top, Side, and Front views respectively, of a typical V-hull boat with a navigation light system according to an embodiment of the present invention.
Figure 45S:
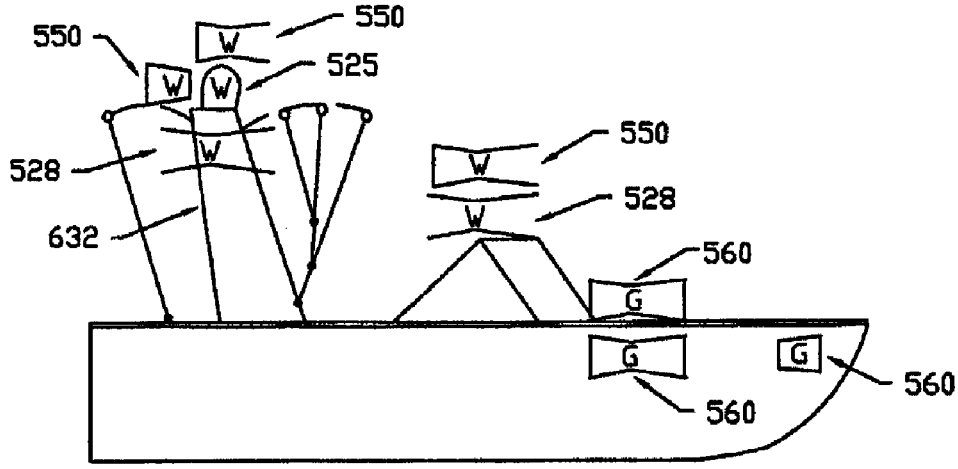
Figure 45F:
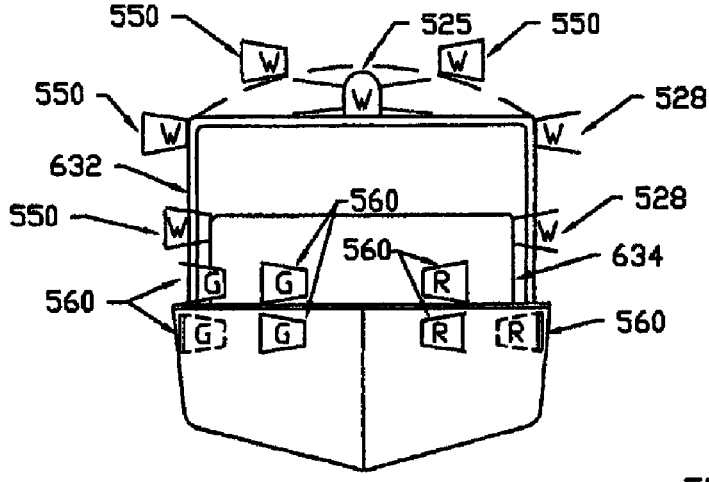

FIG. 45T is a top view of a boat with a radar arch 632 and a windshield 634. The starboard side of the boat is shown with partial arc white lights 550. The boat is also fitted on the port side with half all around lights 528 as shown in FIG. 41 and FIG. 43. The half all around lights or the partial arc white lights can be mounted on either the radar arch or the windshield. FIG. 45S is a side view of FIG. 45T and shows the half all around lights and the partial arc white lights. The radar arc shows a folding canvas top attached to it as customary to some boats but is not necessary to the implementation of a navigation light system according to an embodiment of the present invention. FIG. 45F is a front view of FIG. 45T and shows how the folding canvas top sometimes rises above the lines of the radar arch and why it would be advantageous to use lights mounted towards the edges of the radar arch to prevent them from being occluded by the canvas top. This raised center portion of the canvas top is fairly common and renders prior art all around white light 525 useless because the light becomes occluded when viewed by a distant observer located at the front of the boat.

Figure 46T:
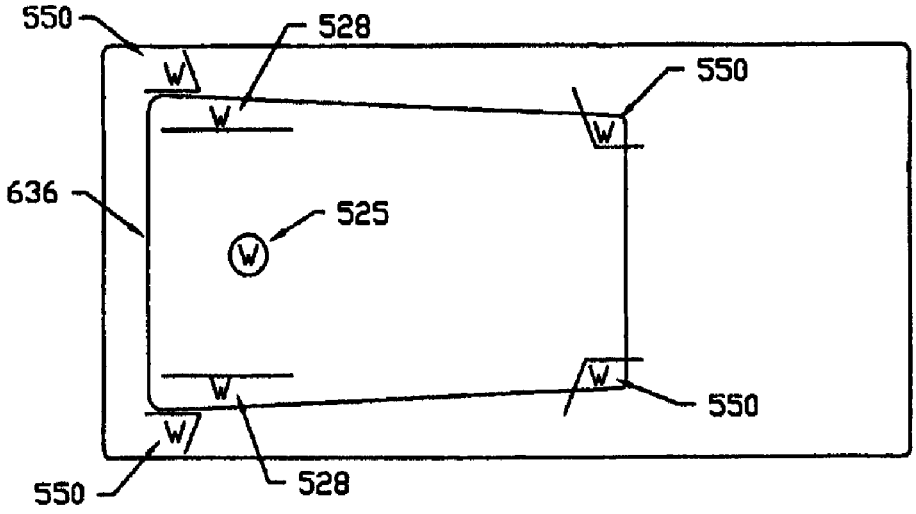
FIG. 46T, FIG. 46S, and FIG. 46F, are the Top, Side, and Front views respectively, of a typical houseboat with a navigation light system according to an embodiment of the present invention.
Figure 46S:
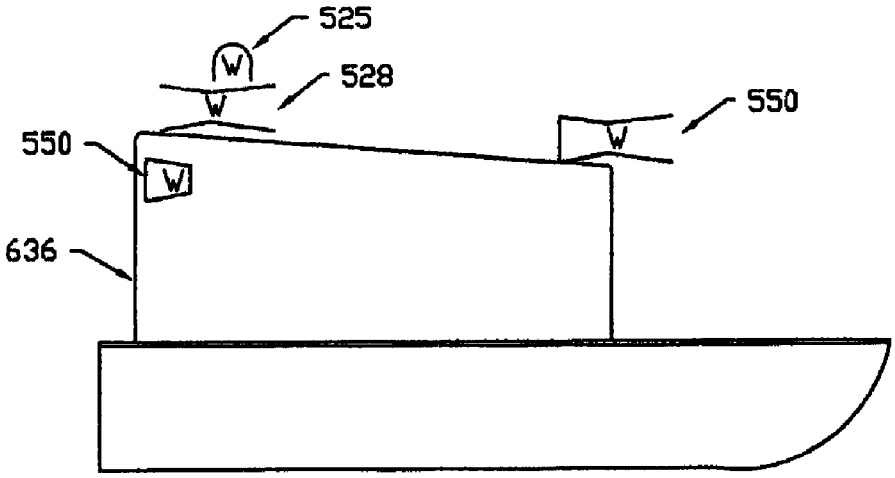
Figure 46F:
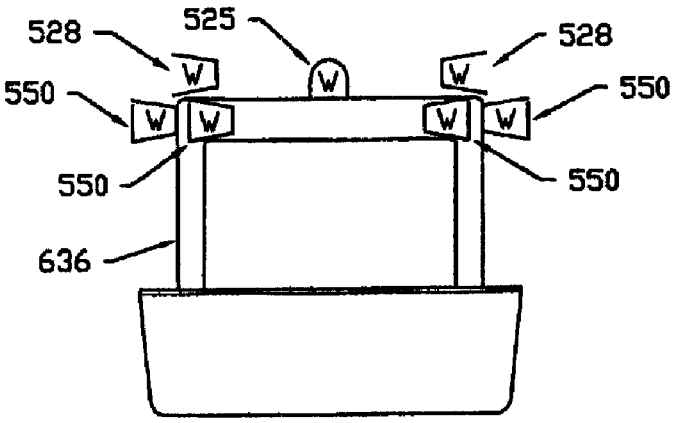

FIG. 46T is a type of boat with a house located on the deck area. The house 636 is usually a rigid, somewhat rectangular structure and may have considerable clutter scattered on the roof area. This clutter may be air conditioning units, radar domes, lawn chairs, rubber rafts, or other objects. Prior art provide a single all around white light 525 mounted towards the rear area of the top roof area. The prior art light is often occluded by the clutter and causes a dangerous situation in which a distant observer cannot see the subject boat. A navigation light system according to an embodiment of the present invention uses half all around lights 528 as shown in FIG. 8, or FIG. 41, or FIG. 43. A navigation light system according to an embodiment of the present invention also uses partial arc white lights 550 at edges of the roof. FIG. 46S is a side view of FIG. 46T and shows prior art all around light 525, half all around light 528, and partial arc white light 550. The roof may be sloped or level. FIG. 46F is a front view of FIG. 46T and shows prior art all around light 525, half all around light 528, and partial arc white light 550.

Figure 47:
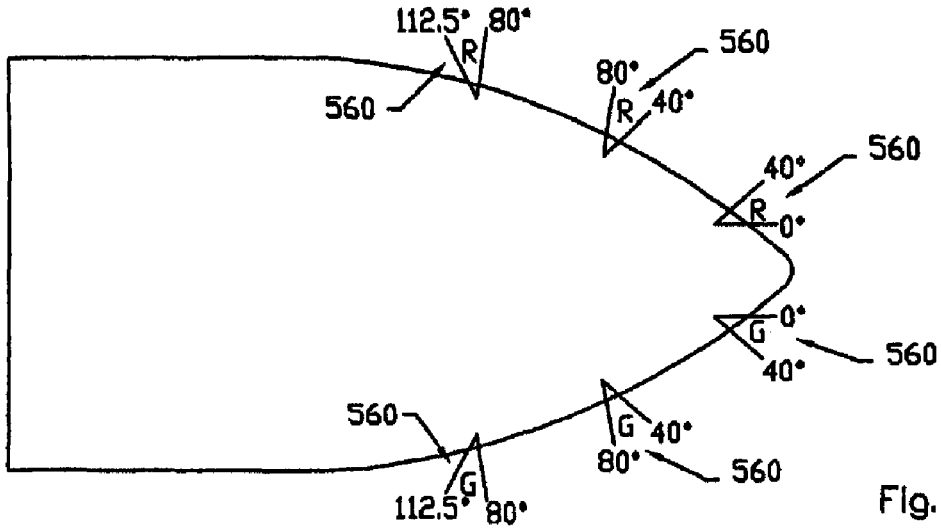
FIGS. 47-49 are top views of a typical V-hull boat with a navigation light system according to various embodiments of the present invention.

FIG. 47 is a top view of a boat with partial arc colored lights 560 showing red lights on the port side and green lights on the starboard side. These lights have a fairly narrow angle of emission. This is like FIG. 24.

Figure 48:
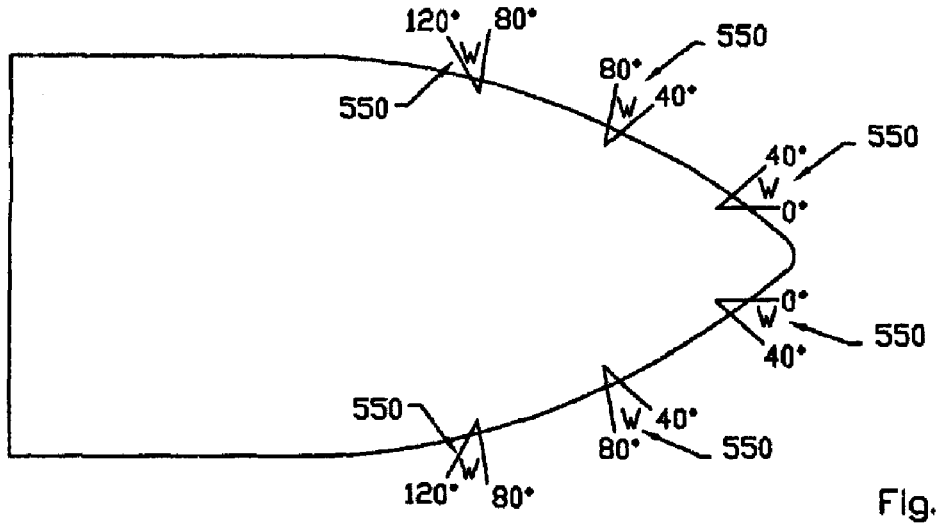

FIG. 48 is a top view of a boat with partial arc white lights 550. These lights have a fairly narrow angle of emission. This is like FIG. 19.

Figure 49:
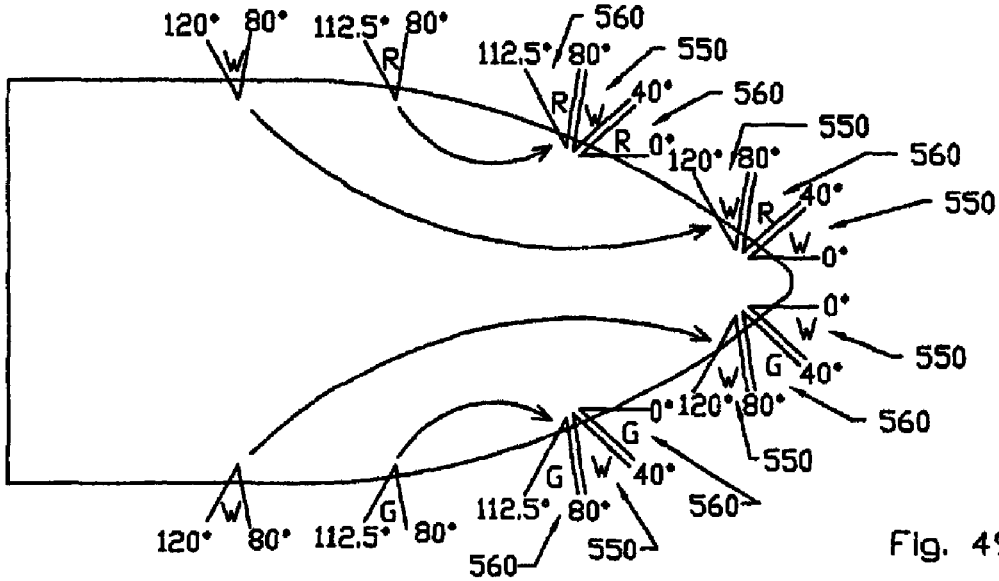

FIG. 49 is a top view of a boat that combines the lights of FIG. 47 and FIG. 48. Note how the lights towards the rear and sides of the boat can be moved in accordance with the arrows and located in arranged clusters to yield a system that is a spatial separate, piecewise continuous, partial arc light that meets the color presentation requirements of the Navigation Rules.

A distant observer located dead ahead of the subject boat sees a pair of white lights located close together at the front of the boat and will also see a red light horizontally offset to the port side and a green light horizontally offset on the starboard side of the subject boat. As the distant observer passes to the port side of the subject boat and passes the 40 degree point, the front mounted white light suddenly seems to turn red and the side mounted red light likewise seems to turn white. The lights didn't turn off, or change it's color, rather the distant observer simply passed the cutoff point of the partial arc lights of each color. Of course, the green light seemed to disappear as soon as the observer passed over to the port side of the subject boat. As the distant observer continues along the port side he will continue to see the red light in front of the white light until he reaches the 80 degree position at which time the lights will again seem to change colors and the observer will see a white light at the front of the boat and see a red light rearward of the white light. These two lights are located far enough apart to ensure visual separation of the two colors. This embodiment is suitable to lamps with narrow beam spread and may be especially suitable for LED's. The visual presentation on the starboard side is similar except the green light is substituted for the red light.

Figure 50T:
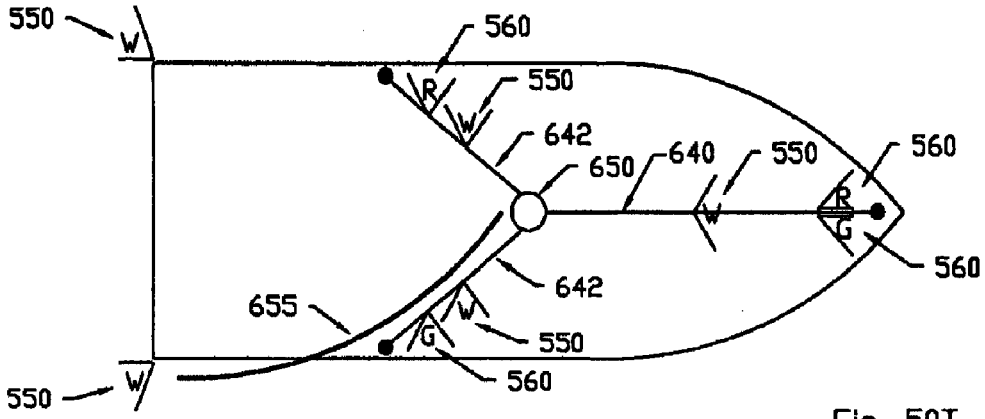
FIG. 50T, FIG. 50S, and FIG. 50F, are the Top, Side, and Front views respectively, of a typical sailboat with a navigation light system according to an embodiment of the present invention.
Figure 50F:
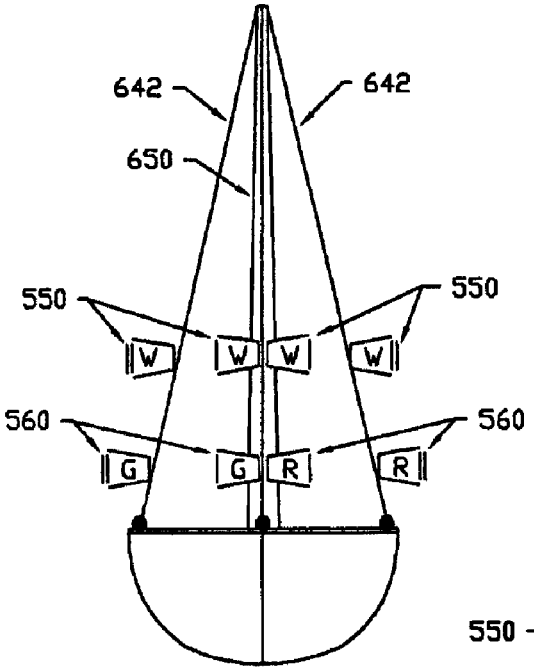
Figure 50S:
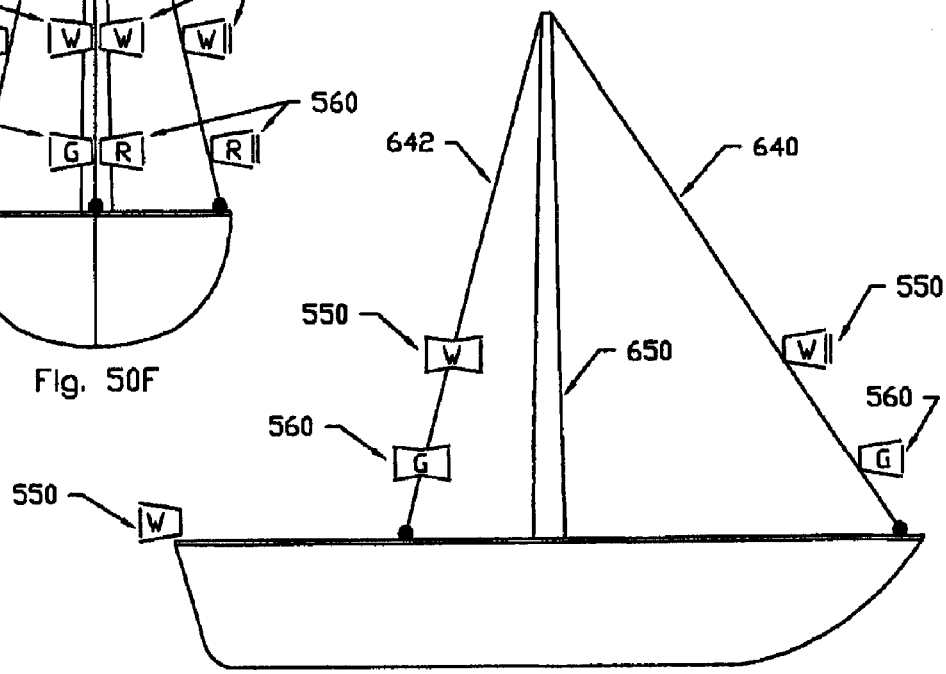

FIG. 50T is the top view of a sailboat with a mast 650 and front guy line 640 and side guy lines 642. Prior art (not shown) usually placed a white light at or near the top of the mast. Prior art placed the light so high that close range observers often didn't see the boat because the light was above their area of intense concentration. Sail 655 is shown billowing out to the side. A navigation light system according to an embodiment of the present invention includes the use of partial arc white lights 550 and partial arc colored lights 560 affixed to the guy lines. This arrangement allows for sufficient spatial separation of the white light from the color lights. This arrangement also reduces the problem of glare and the problem of occlusion due to objects in the path of the outwardly directed light. FIG. 50F is the front view of FIG. 50T and shows the vertical separation of the lights. FIG. 50S is the side view of FIG. 50T and shows the vertical separation of the lights.

Figure 51T:
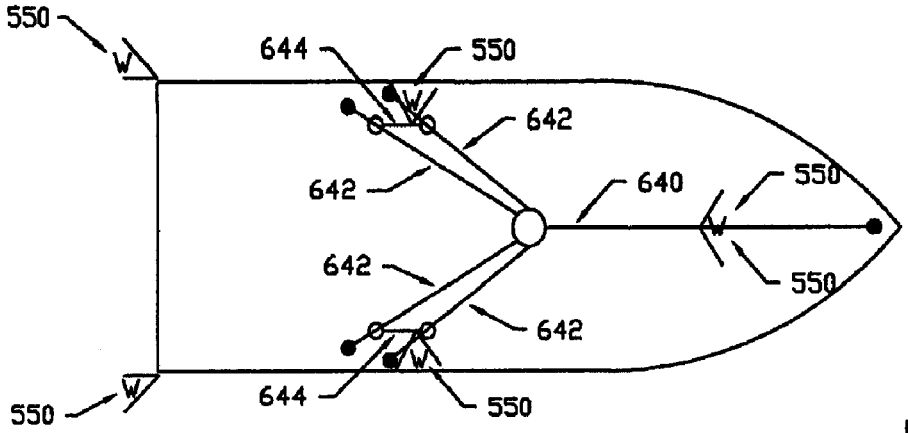
FIG. 51T, FIG. 51S, and FIG. 51F, are the Top, Side, and Front views respectively, of a typical sailboat with a navigation light system according to an embodiment of the present invention.
Figure 51F:
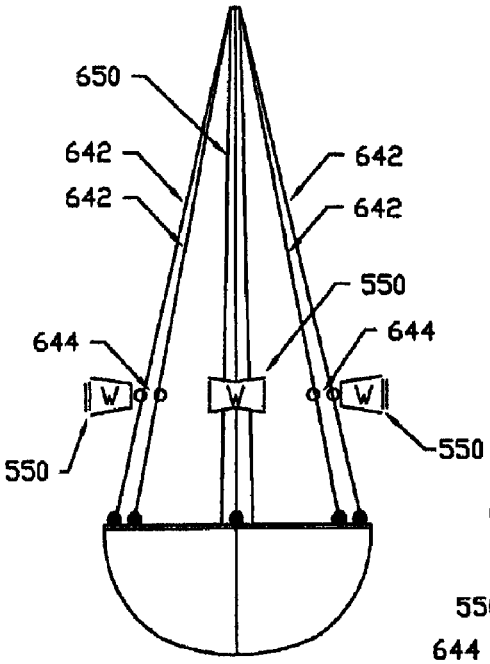
Figure 51S:
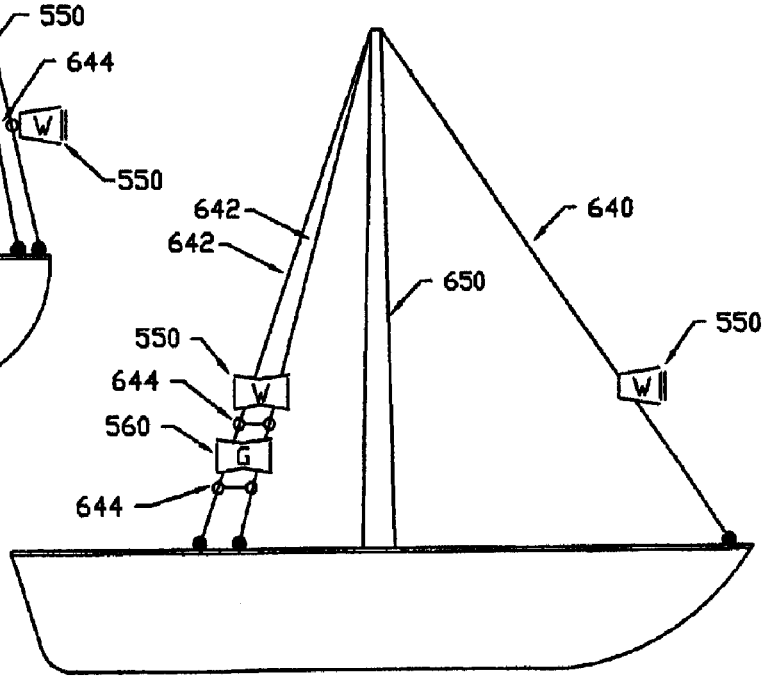

FIG. 51T is the top view of a sailboat similar to FIG. 50, except the mast 650 is supported by two guy lines 642 on each side of the boat. This is common practice and lends itself to the use of a guy bridge 644 mounted to the pair of guy wires. This guy bridge provides a non-rotating mounting point for the partial arc white lights 550 and the partial arc colored lights 560. FIG. 51F is the front view of FIG. 5T and shows the vertical separation of the lights and how they are mounted to the guy bridge on each side of the boat. FIG. 51S is the side view of FIG. 51T and shows the vertical separation of the lights and how they are mounted to the guy bridge on the side of the boat.

Figure 52:
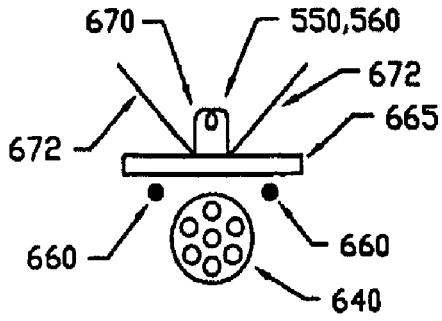
FIG. 52 is a cross sectional view of a guy wire and a navigation light system according to an embodiment of the present invention for use on a sailboat.

FIG. 52 is a cross sectional view of a guy line 640 with a torque tube 665 secured to the guy line. Partial arc white light 550 or partial arc colored light 560 is secured to the torque tube. The guy line is shown as seven circles representing seven strands in a bundle. The two electrical wires 660 carry electricity up the outside of the guy wire from the deck of the boat to supply power to the lights shown as just a curly wire representing the filament 670 of the lamp. The two divergent lines from the torque tube are the light fixture edges 672 and limit the horizontal spread of the light beam. The torque tube is a flat strip of rigid material that resists twisting and helps to keep the light oriented in the correct direction despite having the guy wire twisting under load variations.

Figure 53:
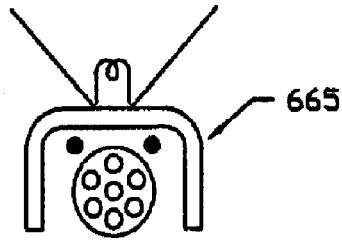
FIG. 53 is a cross sectional view of a guy wire and a navigation light system according to an embodiment of the present invention for use on a sailboat.

FIG. 53 is similar to FIG. 52 except the torque tube has more material and is bent in a U-shape to protect the electrical wires.

Figure 54:
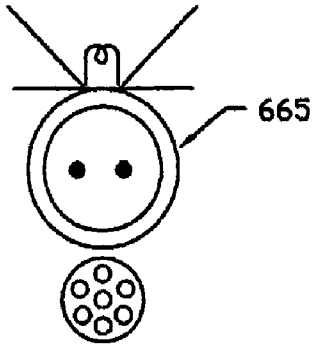
FIG. 54 is a cross sectional view of a guy wire and navigation light for use on a sailboat.

FIG. 54 is similar to FIG. 53 except the torque tube is cylindrical in cross section to increase stiffness against twisting.

Figure 55:
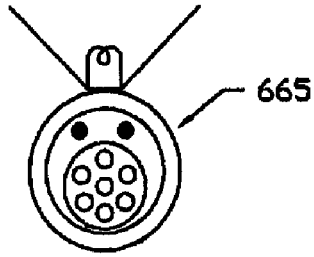
FIG. 55 is a cross sectional view of a guy wire and a navigation light system according to an embodiment of the present invention for use on a sailboat.

FIG. 55 is similar to FIG. 54 except the power wires are routed internally down the length of the torque tube to protect the wires.

Figure 56:
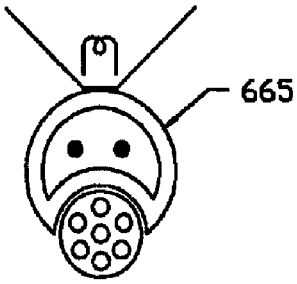
FIG. 56 is a cross sectional view of a guy wire and a navigation light system according to an embodiment of the present invention for use on a sailboat.

FIG. 56 is similar to FIG. 54 except the torque tube is shaped like a crescent to allow the guy wire to nest into the curvature of the torque tube.

Figure 57:
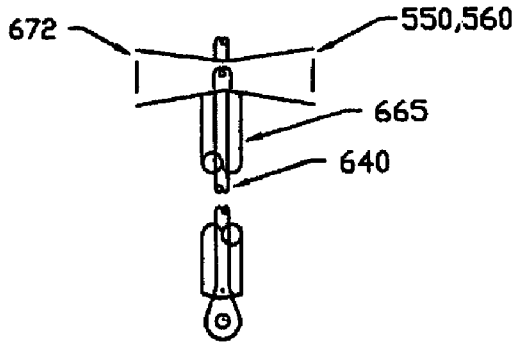
FIG. 57 is a foreshortened view of a guy wire, torque tube, and a navigation light system according to an embodiment of the present invention for use on a sailboat.

FIG. 57 is a view of a light 550 or 560 mounted to a torque tube 665 with a guy wire 640 routed down the length of the torque tube similar to FIG. 55. The bottom of the guy wire shows a loop for attaching to the deck of the sailboat.

FIGS. 58, 59, 60, and 61 are explanations of the graphical representations of the half all around lights 560 and the partial arc lights 550 as shown on previous figures.

Figure 58:
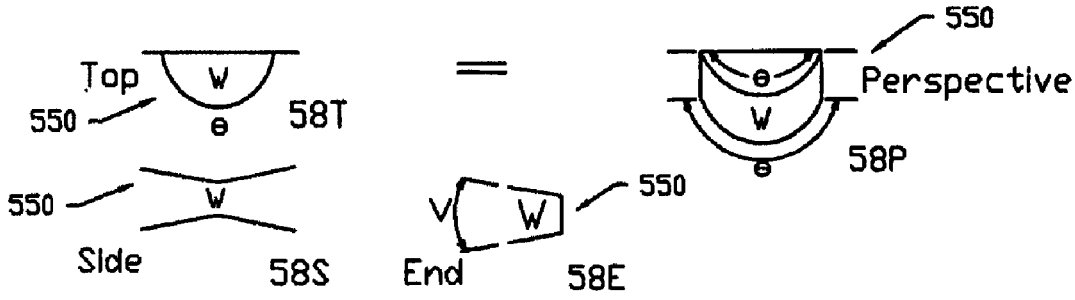
FIG. 58 is a combination of a top (T), side (S), end (E), and perspective (P) view of a partial arc light that has a 180 degree angle of emission.

FIG. 58 is comprised of four views of a half all around light 560 as viewed from four angles. The suffix T is a Top view. The suffix S is a Side view. The suffix E is an End view. The suffix P is a Perspective view. FIG. 58T shows a light that broadcasts light over a full 180 degrees of horizontal spread. FIG. 58S shows no edge lines, which means that the vanishing point of the edge of the fixture is at an infinite distance to both the left and right of the lamp. FIG. 58E shows a light that broadcasts light out to the left of the fixture and has a vertical beam spread V to limit the up or down spread of the light. FIG. 58P shows a light as seen in perspective from the side and above the light.

Figure 59:
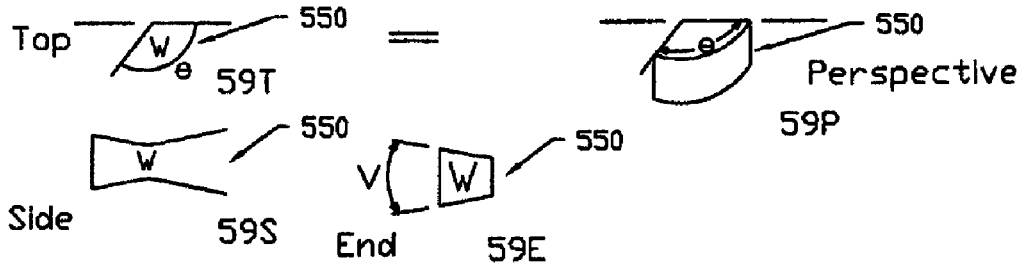
FIG. 59 is a combination of a top (T), side (S), end (E), and perspective (P) view of a partial arc light that has an angle of emission less than 180 degrees but greater than 90 degrees. This light is shown to represent a light that emits light towards the front or towards the rear of a boat.

FIG. 59 is comprised of four views of a partial arc light 550 as viewed from four angles. The suffix T is a Top view. The suffix S is a Side view. The suffix E is an End view. The suffix P is a Perspective view. FIG. 59 has an included angle of greater than 90 degrees but less than 180 degrees. FIG. 59S shows how the vanishing point of the right side of the fixture is at infinite distance. FIG. 59E shows a solid vertical line on the left edge to indicate a finite cutoff angle of the light fixture.

Figure 60:
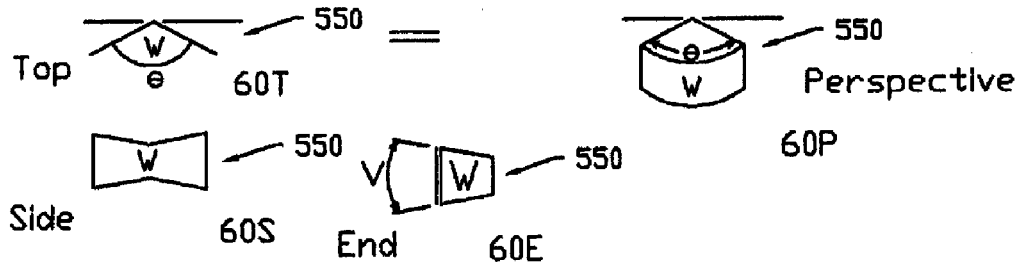
FIG. 60 is a combination of a top (T), side (S), end (E), and perspective (P) view of a partial arc light that has an angle of emission similar to FIG. 58, but is rotated to represent a partial arc light mounted on the side of a boat.

FIG. 60 is comprised of four views of a partial arc light 550 as viewed from four angles. The suffix T is a Top view. The suffix S is a Side view. The suffix E is an End view. The suffix P is a Perspective view. FIG. 60S shows a light similar to FIG. 59 but is rotated to define a finite edge on both the left and right side of the fixture as shown by the solid vertical line on both the left and right side of the fixture. FIG. 60E shows two solid vertical lines to on the left of the fixture to define a finite cutoff line on both sides of the fixture when viewed from the top.

Figure 61:
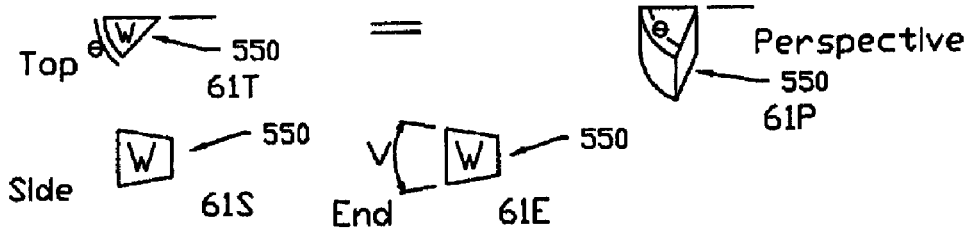
FIG. 61 is a combination of a top (T), side (S), end (E), and perspective (P) view of a partial arc light that has an angle of emission that is less than 90 degrees, where the light represents a light with a narrow angle of emission that emits light towards the front or towards the rear of the boat.

FIG. 61 is comprised of four views of a partial arc light 550 as viewed from four angles. The suffix T is a Top view. The suffix S is a Side view. The suffix E is an End view. The suffix P is a Perspective view. FIG. 61S shows a light similar to FIG. 59S but has an included angle of less than 90 degrees and one side has an infinite vanishing point and the other side has a finite vanishing point shown as a single vertical line. FIG. 61E shows a single solid vertical line to the left of the fixture to define a finite cutoff line on only one side of the fixture.

Figure 62:
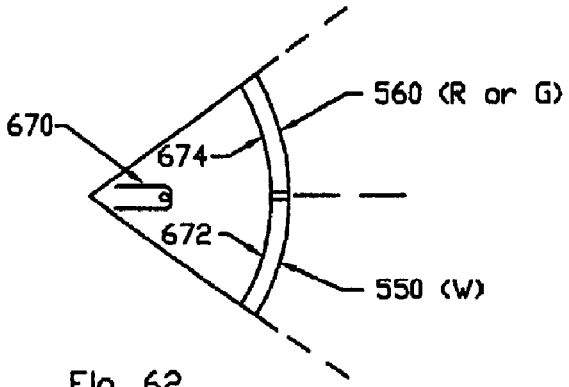
FIG. 62 is a top view of a bicolor light using a single lamp and a white lens combined with a colored lens, where the colored lens may be red, or green, or yellow as necessary.

FIG. 62 is a top view of a simplified bicolor light fixture comprised of a single lamp with a filament 670 shining light through two separate lenses. White light rays from the filament shine through a clear or white lens 672 to produce a white light 550 and shine through a colored lens 674 to produce either a red or green colored light 560. This light is similar to that shown in FIG. 27 or FIG. 28. A yellow light may be used instead of the colored light if so required by the Navigation Rules to define certain types of boats or activity. The fixture is rotated to the desired orientation on the boat and secured to shine outwardly in the desired direction.

Figure 63:
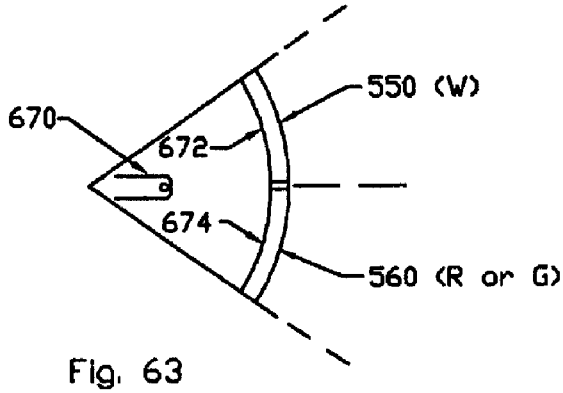
FIG. 63 is a top view of a bicolor light using a single lamp and a white lens combined with a colored lens, where the colored lens may be red, or green, or yellow as necessary.

FIG. 63 is a top view of a simplified bicolor light fixture comprised of a single lamp with a filament 670 shining light through two separate lenses. White light rays from the filament shine through a clear or white lens 672 to produce a white light 550 and shine through a colored lens 674 to produce either a red or green colored light 560. This light is similar to that shown in FIG. 27 or FIG. 28. A yellow light may be used instead of the colored light if so required by the Navigation Rules to define certain types of boats or activity. The fixture is rotated to the desired orientation on the boat and secured to shine outwardly in the desired direction.

Figure 64:
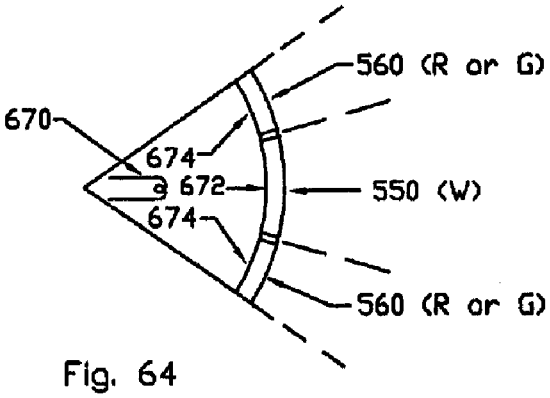
FIG. 64 is a top view of a bicolor light using a single lamp and a white lens combined with a colored lens, where the colored lens may be red, or green, or yellow as necessary.

FIG. 64 is a top view of a simplified bicolor light fixture comprised of a single lamp with a filament 670 shining light through two separate lenses. White light rays from the filament shine through a clear or white lens 672 to produce a white light 550 and shine through a colored lens 674 to produce either a red or green colored light 560. This light is similar to that shown in FIG. 49. A yellow light may be used instead of the colored light if so required by the Navigation Rules to define certain types of boats or activity. The fixture is rotated to the desired orientation on the boat and secured to shine outwardly in the desired direction.

Figure 65:
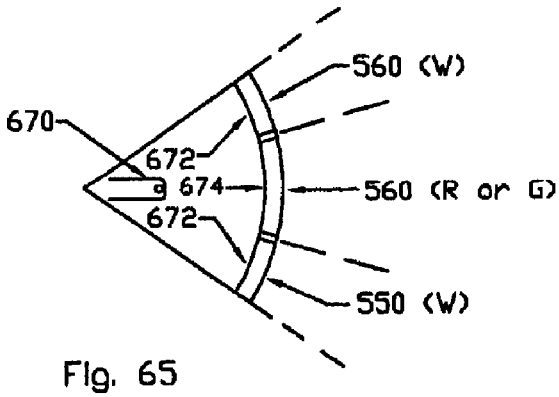
FIG. 65 is a top view of a bicolor light using a single lamp and a white lens combined with a colored lens, where the colored lens may be red, or green, or yellow as necessary.

FIG. 65 is a top view of a simplified bicolor light fixture comprised of a single lamp with a filament 670 shining light through two separate lenses. White light rays from the filament shine through a clear or white lens 672 to produce a white light 550 and shine through a colored lens 674 to produce either a red or green colored light 560. This light is similar to that shown in FIG. 49. A yellow light may be used instead of the colored light if so required by the Navigation Rules to define certain types of boats or activity. The fixture is rotated to the desired orientation on the boat and secured to shine outwardly in the desired direction.

A navigation light system for a watercraft according to an embodiment of the present invention includes a plurality of lights spatially separated on the watercraft to collectively operate as a navigation running light that has a specified horizontal beam sector of less than 360 degrees. The lights have a common color and each light is separately masked to emit light outwardly from the watercraft within a partial arc horizontal beam sector, in which the partial arc horizontal beam sector is less than the specified horizontal beam sector. The lights may be red, white or green or any other color acceptable as a navigation running light according to the Navigation Rules. Also, each light may be masked to limit its vertical beam sector to less than 180 degrees.

A navigation light system for a watercraft according to another embodiment of the present invention includes first and second running lights, each including a plurality of lights of a common color spatially separated on the watercraft and collectively having a specified horizontal beam sector of less than 360 degrees. Each light of each of the first and second running lights is separately masked within a corresponding one of mutually exclusive partial arc horizontal beam sectors within the specified horizontal beam sector. The first and second running lights may be any acceptable color combination appropriate for the Navigation Rules, such as white and red, white and green, green and red, etc. Also, each light may be masked to limit its vertical beam sector to less than 180 degrees.

A watercraft according to another embodiment of the present invention includes a hull and a plurality of lights spatially separated on the hull to collectively operate as a navigation running light that has a specified horizontal beam sector of less than 360 degrees. The lights have a common color and each light is separately masked to emit light outwardly from the hull within a partial arc horizontal beam sector, in which the partial arc horizontal beam sector is less than the specified horizontal beam sector. The lights may be red, white or green or any other color acceptable as a navigation running light according to the Navigation Rules. Also, each light may be masked to limit its vertical beam sector to less than 180 degrees. Any one or more of the lights may be spatially separated on appurtenances mounted to the hull.

Although the present invention has been described in considerable detail with reference to certain preferred versions thereof, other versions and variations are possible and contemplated. Finally, those skilled in the art should appreciate that they can readily use the disclosed conception and specific embodiments as a basis for designing or modifying other structures for carrying out the same purposes of the present invention without departing from the spirit and scope of the invention as defined by the appended claims.

What is claimed is:

1. A watercraft, comprising:

a hull;

a plurality of running lights spatially separated on said hull to collectively emit light outwardly from said hull at every angle within a specified horizontal beam sector of less than 360 degrees;

wherein said plurality of running lights have a common color;

wherein said specified horizontal beam sector is divided into a plurality of partial arc horizontal beam sectors which are angularly mutually exclusive with respect to each other, wherein each of said plurality of partial arc horizontal beam sectors is less than said specified horizontal beam sector and wherein a sum of said plurality of partial arc horizontal beam sectors is equal to said specified horizontal beam sector; and wherein each of said plurality of running lights is separately masked to emit light outwardly from said hull only within a corresponding one of said plurality of partial arc horizontal beam sectors other than any minimal angular overlap of emitted light between any two of said plurality of partial arc horizontal beam sectors.

2. The watercraft of claim 1, wherein said common color is white.

3. The watercraft of claim 1, wherein said common color is green.

4. The watercraft of claim 1, wherein said common color is red.

5. The watercraft of claim 1, wherein each of said plurality of running lights are masked to limit its vertical beam sector to less than 180 degrees.

6. The watercraft of claim 1, further comprising appurtenances mounted to said hull, and wherein at least one of said plurality of running lights is mounted on said appurtenances.

7. A watercraft, comprising:

having a first side and a second side a hull;

a plurality of first running lights of a first color spatially separated on said first side of said hull and collectively emitting light outwardly from said hull at every angle within a first specified horizontal beam sector of less than 360 degrees;

wherein said first specified horizontal beam sector is divided into a first plurality of partial arc horizontal beam sectors which are angularly mutually exclusive with respect to each other, wherein each of said first plurality of partial arc horizontal beam sectors is less than said first specified horizontal beam sector and wherein a sum of said first plurality of partial arc horizontal beam sectors is equal to said first specified horizontal beam sector;

wherein each of said plurality of first running lights is separately masked to emit light outwardly from said hull only within a corresponding one of said first plurality of partial arc horizontal beam sectors within said first specified horizontal beam sector other than any minimal angular overlap of emitted light between any two of said first plurality of partial arc horizontal beam sectors;

a plurality of second running lights of a second color spatially separated on said second side of said hull and collectively emitting light outwardly from said hull at every angle within a second specified horizontal beam sector of less than 360 degrees;

wherein said second specified horizontal beam sector is divided into a second plurality of partial arc horizontal beam sectors which are angularly mutually exclusive with respect to each other, wherein each of said second plurality of partial arc horizontal beam sectors is less than said second specified horizontal beam sector and wherein a sum of said second plurality of partial arc horizontal beam sectors is equal to said second specified horizontal beam sector; and wherein each of said plurality of second running lights is separately masked to emit light outwardly from said hull only within a corresponding one of said second plurality of partial arc horizontal beam sectors within said second specified horizontal beam sector other than any minimal angular overlap of emitted light between any two of said second plurality of partial arc horizontal beam sectors.

8. The watercraft of claim 7, wherein said first color is white and said second color is green.

9. The watercraft of claim 7, wherein said first color is white and said second color is red.

10. The watercraft of claim 7, wherein said first color is green and said second color is red.

11. The watercraft of claim 7, wherein each of said plurality of first and second running lights are masked to limit its vertical beam sector to less than 180 degrees.

12. The watercraft of claim 7, further comprising appurtenances mounted to said hull, and wherein at least one of said plurality of first and second running lights is mounted on said appurtenances.

* * * * *